US011945629B2

(12) United States Patent
Bressan et al.

(10) Patent No.: US 11,945,629 B2
(45) Date of Patent: Apr. 2, 2024

(54) CHILD-PROOF CONTAINER AND PROCESS FOR MAKING THE SAME

(71) Applicant: I.G.B. S.R.L., Milan (IT)

(72) Inventors: Michel Bressan, Induno Olona (IT); Alberto Gandolla, Induno Olona (IT); Alessio Bressan, Varese (IT)

(73) Assignee: I.G.B. S.R.L., Milan (IT)

( * ) Notice: Subject to any disclaimer, the term of this patent is extended or adjusted under 35 U.S.C. 154(b) by 0 days.

(21) Appl. No.: 17/962,412

(22) Filed: Oct. 7, 2022

(65) Prior Publication Data

US 2023/0113321 A1 Apr. 13, 2023

(30) Foreign Application Priority Data

Oct. 8, 2021 (IT) ..... 102021000025892

(51) Int. Cl.
*B65D 5/38* (2006.01)
*B65D 5/66* (2006.01)
*B65D 5/68* (2006.01)

(52) U.S. Cl.
CPC ..... *B65D 5/38* (2013.01); *B65D 5/665* (2013.01); *B65D 5/685* (2013.01); *B65D 2215/02* (2013.01)

(58) Field of Classification Search
CPC ..... B65D 5/38; B65D 5/685; B65D 2215/02; B65D 5/6608; B65D 5/4608; B65D 5/665; Y10S 206/807; Y10S 206/815
USPC ..... 229/125.6, 145, 125.125, 225; 206/1.5, 206/807, 531, 815
See application file for complete search history.

(56) References Cited

U.S. PATENT DOCUMENTS

| | | | | |
|---|---|---|---|---|
| 1,130,271 A | | 3/1915 | Hammond | |
| 1,253,489 A | | 1/1918 | Houghland | |
| 2,395,364 A | * | 2/1946 | Williams | B65D 5/304 206/815 |
| 2,456,841 A | * | 12/1948 | Rushing | B65D 5/685 229/125.26 |
| 2,559,320 A | * | 7/1951 | Rushing | B65D 5/685 229/125.26 |
| 2,695,128 A | * | 11/1954 | Rendall | B65D 5/22 229/148 |

(Continued)

FOREIGN PATENT DOCUMENTS

| | | |
|---|---|---|
| CN | 204642380 | 9/2015 |
| EP | 2 808 265 | 12/2014 |

(Continued)

OTHER PUBLICATIONS

Search Report for IT Application No. 202100025892 dated May 19, 2022, 7 pages.

*Primary Examiner* — Steven A. Reynolds
*Assistant Examiner* — Prince Pal
(74) *Attorney, Agent, or Firm* — Nixon & Vanderhye P.C.

(57) ABSTRACT

A child-proof container including a storage having a lateral wall, a closure system of the storage, a first coupling portion carried by the closure system, a second coupling portion carried by the storage and configured for cooperating with said first coupling portion for locking the container in a closed condition. The second coupling portion includes a tab from the lateral wall of the storage. The container includes a spacer interposed between the tab of the second coupling portion and the lateral wall.

20 Claims, 10 Drawing Sheets

(56) References Cited

U.S. PATENT DOCUMENTS 2,777,629 A * 1/1957 Osteen ..... B65D 5/6667 229/145
2,809,775 A * 10/1957 White ..... B65D 5/685 229/117.17
2,970,742 A * 2/1961 Fleisig ..... B65D 5/685 229/921
3,126,092 A * 3/1964 Maron ..... B65D 5/38 206/246
3,187,980 A * 6/1965 Oas ..... B65D 5/685 229/125.26
3,642,193 A * 2/1972 Rada ..... B65D 5/30 229/149
3,692,231 A * 9/1972 Neitzke ..... B65D 5/685 206/815
4,053,100 A * 10/1977 Baptist ..... B65D 5/685 229/125.26
4,113,104 A * 9/1978 Meyers ..... B65D 5/5425 229/172
4,196,843 A * 4/1980 Garmon ..... B65D 5/685 229/165
4,326,634 A * 4/1982 Meyers ..... B65D 5/5435 229/122
4,483,095 A * 11/1984 Webinger ..... A01M 1/2055 239/58
4,717,070 A * 1/1988 Taub ..... B65D 5/685 229/117.16
4,964,561 A * 10/1990 Whelan ..... B65D 5/6667 229/149
5,040,722 A * 8/1991 Fromion ..... B65D 5/6667 229/148
5,351,819 A * 10/1994 Varon ..... B65D 5/48024 206/534
5,398,868 A * 3/1995 Densen ..... B42F 7/14 229/125.28
5,505,374 A * 4/1996 Stone ..... B65D 5/5415 493/162
5,515,996 A * 5/1996 Stone ..... B65D 5/6608 229/125.26
5,725,144 A * 3/1998 Stone ..... B65D 5/6608 229/101
6,168,073 B1 * 1/2001 Towle ..... B65D 5/38 229/122
6,296,175 B1 * 10/2001 Dixon ..... B65D 5/685 229/102
6,484,931 B1 * 11/2002 Hofte ..... B65D 5/6608 229/149
6,491,211 B1 12/2002 Evans et al.
6,604,676 B2 * 8/2003 Giblin ..... B65D 5/543 229/148
6,708,874 B1 * 3/2004 Montgomery ..... B65D 5/4608 206/815
7,726,552 B2 * 6/2010 Chadima ..... B65D 5/685 232/1 D
8,646,680 B2 * 2/2014 Low ..... B65D 5/6667 229/148
8,720,736 B2 * 5/2014 Boland ..... B65D 11/1853 229/117.02
9,027,826 B2 * 5/2015 Bitner ..... B65B 69/00 229/235
9,475,605 B2 10/2016 Everett
11,505,358 B2 * 11/2022 Wang ..... B65D 5/32
2003/0222130 A1 * 12/2003 Fukushima ..... B65D 5/4291 229/149
2005/0173291 A1 8/2005 Specker et al.
2005/0241966 A1 * 11/2005 Giannini ..... B65D 5/38 206/499
2006/0283928 A1 * 12/2006 Walsh ..... B65D 5/744 493/51
2007/0039840 A1 * 2/2007 Mu ..... B65D 5/4295 206/278
2012/0234701 A1 9/2012 Albrecht et al.
2013/0193197 A1 * 8/2013 Low ..... B65D 5/308 229/146
2014/0262839 A1 9/2014 Le et al.
2015/0014404 A1 * 1/2015 Iwata ..... B65D 5/662 229/160.1
2016/0001937 A1 * 1/2016 Skinner ..... B65D 5/38 206/1.5
2016/0251107 A1 * 9/2016 Everett ..... B65D 5/38 206/1.5
2017/0297803 A1 * 10/2017 Chambers ..... B65D 5/10
2018/0022498 A1 * 1/2018 Everett ..... B65D 5/2057 220/682
2019/0062023 A1 * 2/2019 Lantz ..... B65D 77/22
2019/0135503 A1 * 5/2019 De Wilde ..... B65D 50/046
2021/0047072 A1 * 2/2021 Ng Pak Leung .... B65D 5/4608
2021/0347524 A1 * 11/2021 Hoefte ..... B65D 5/68
2022/0009671 A1 * 1/2022 Hoefte ..... B65D 5/445
2022/0081155 A1 * 3/2022 Hoefte ..... B65D 5/685
2022/0185534 A1 * 6/2022 Hoefte ..... B65D 43/0233
2022/0289436 A1 * 9/2022 Hoefte ..... B65D 13/04
2022/0306336 A1 * 9/2022 Bressan ..... B65D 5/68
2022/0315297 A1 * 10/2022 Zirollo ..... B65D 5/6652
2023/0132541 A1 * 5/2023 Hoefte ..... B65D 5/6608 206/1.5
2023/0142224 A1 * 5/2023 Buck ..... B65D 5/38 53/492

FOREIGN PATENT DOCUMENTS

| | | |
|---|---|---|
| EP | 2 810 885 | 12/2014 |
| FR | 783262 | 7/1935 |
| WO | 2005/068304 | 7/2005 |
| WO | 2009/038219 | 3/2009 |
| WO | 2012/112538 | 8/2012 |
| WO | 2021/044266 | 3/2021 |

* cited by examiner

FIG.1
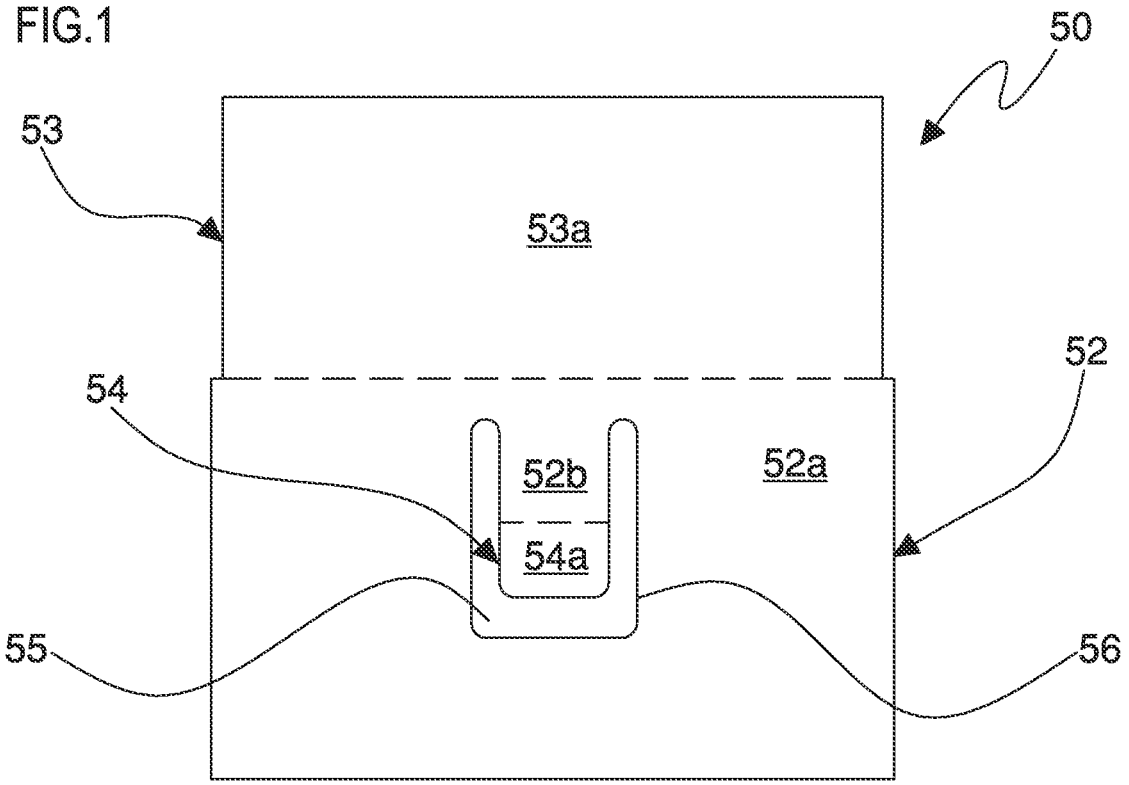
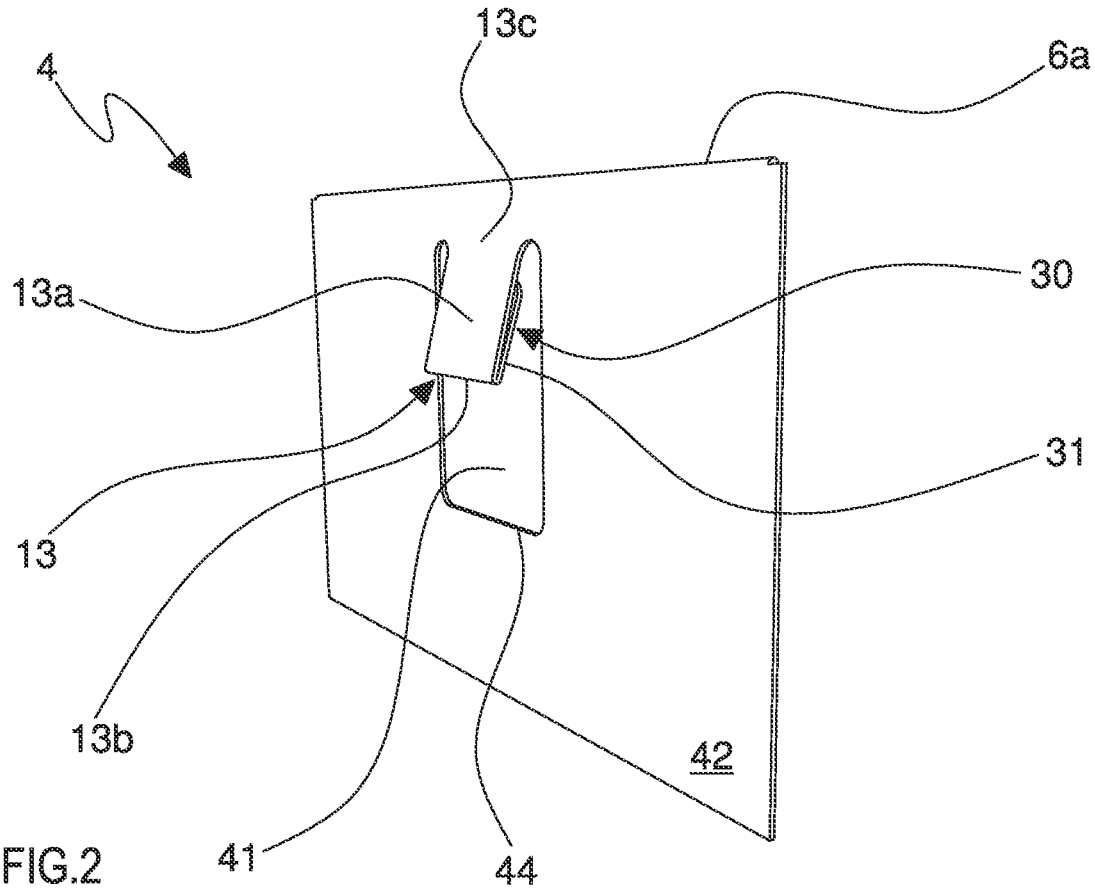
FIG.2

FIG.3
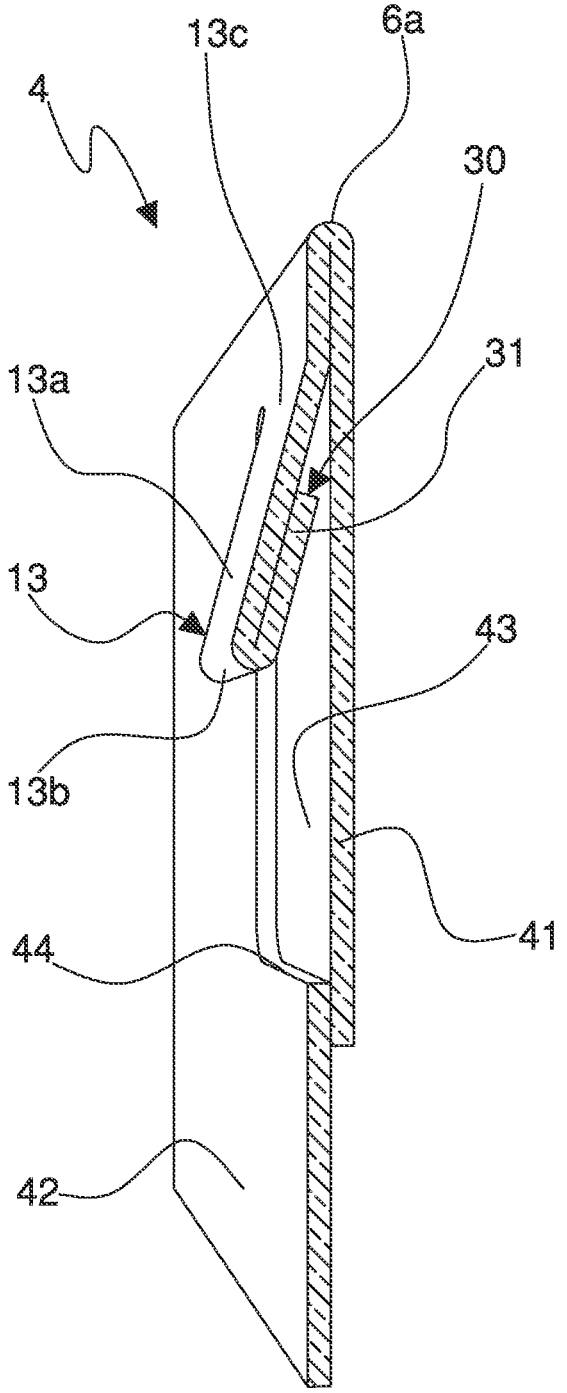
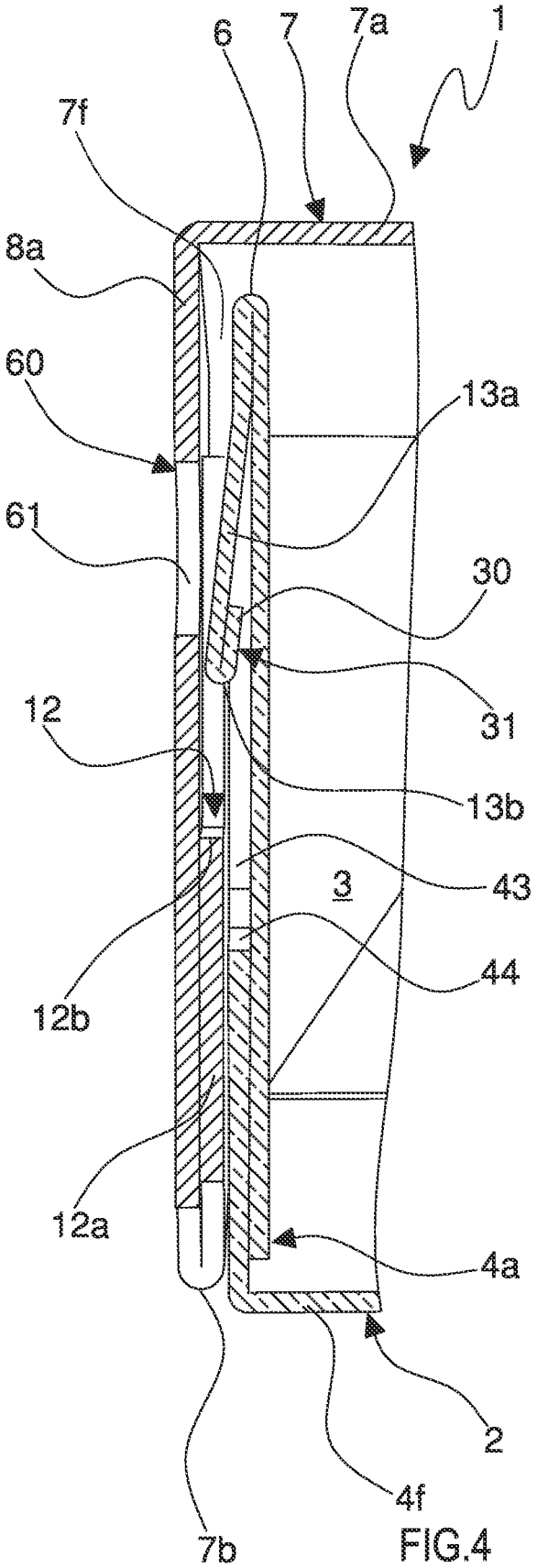
FIG.4

FIG.5
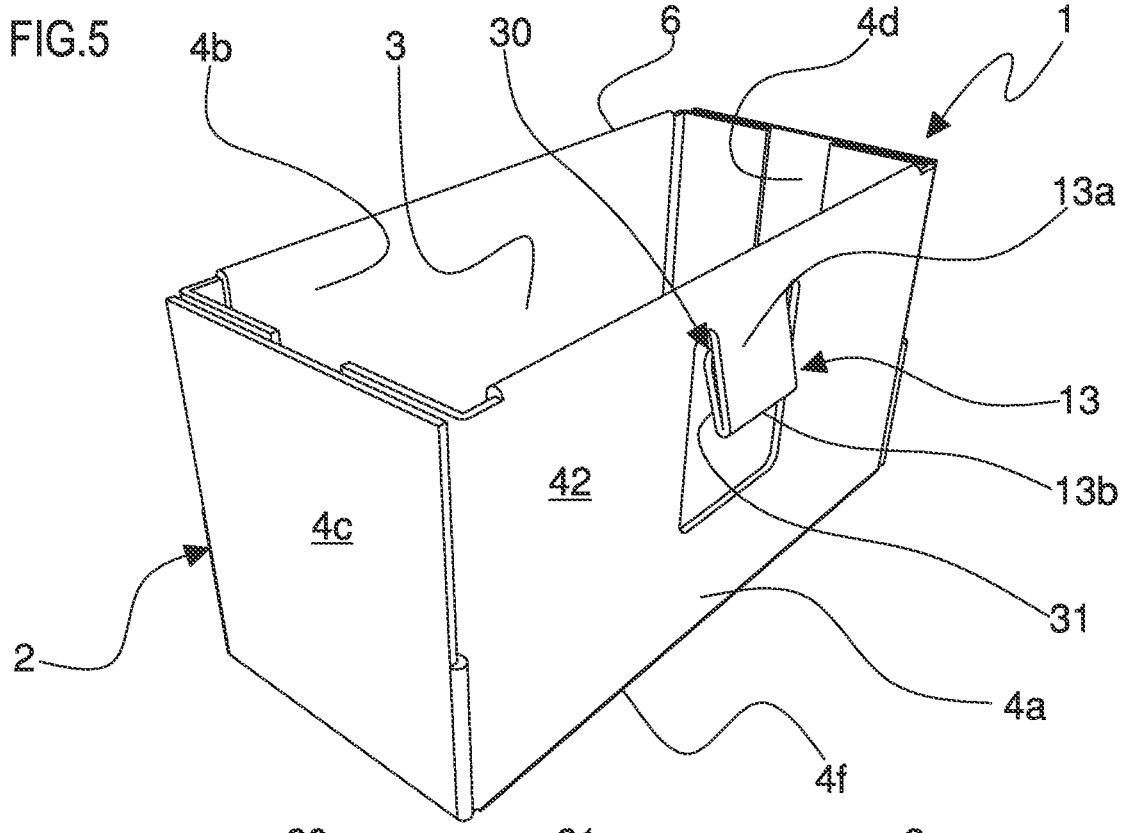
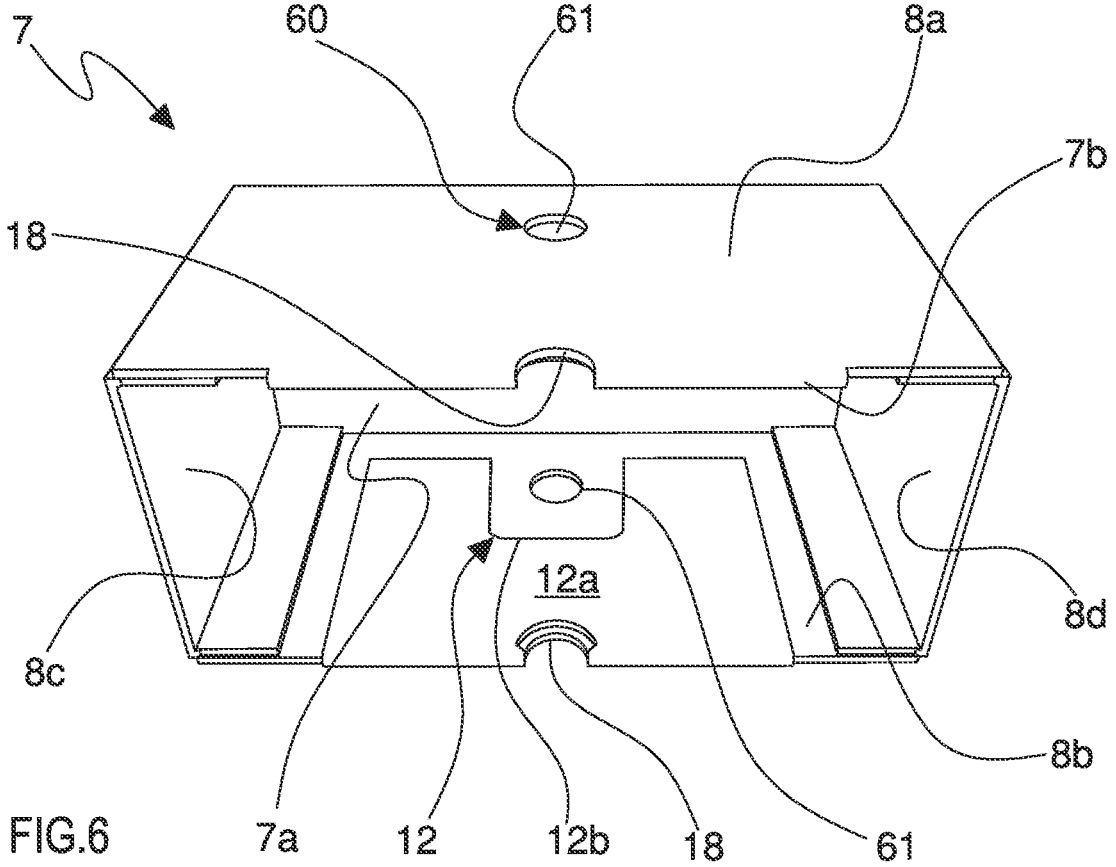
FIG.6

FIG.8
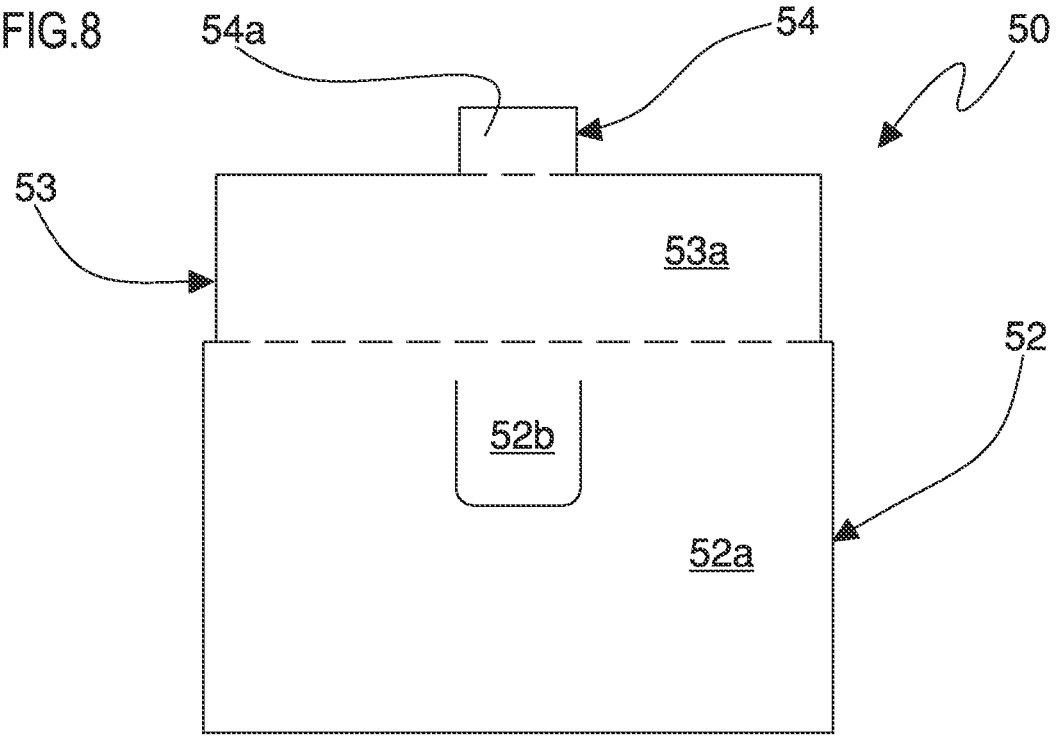
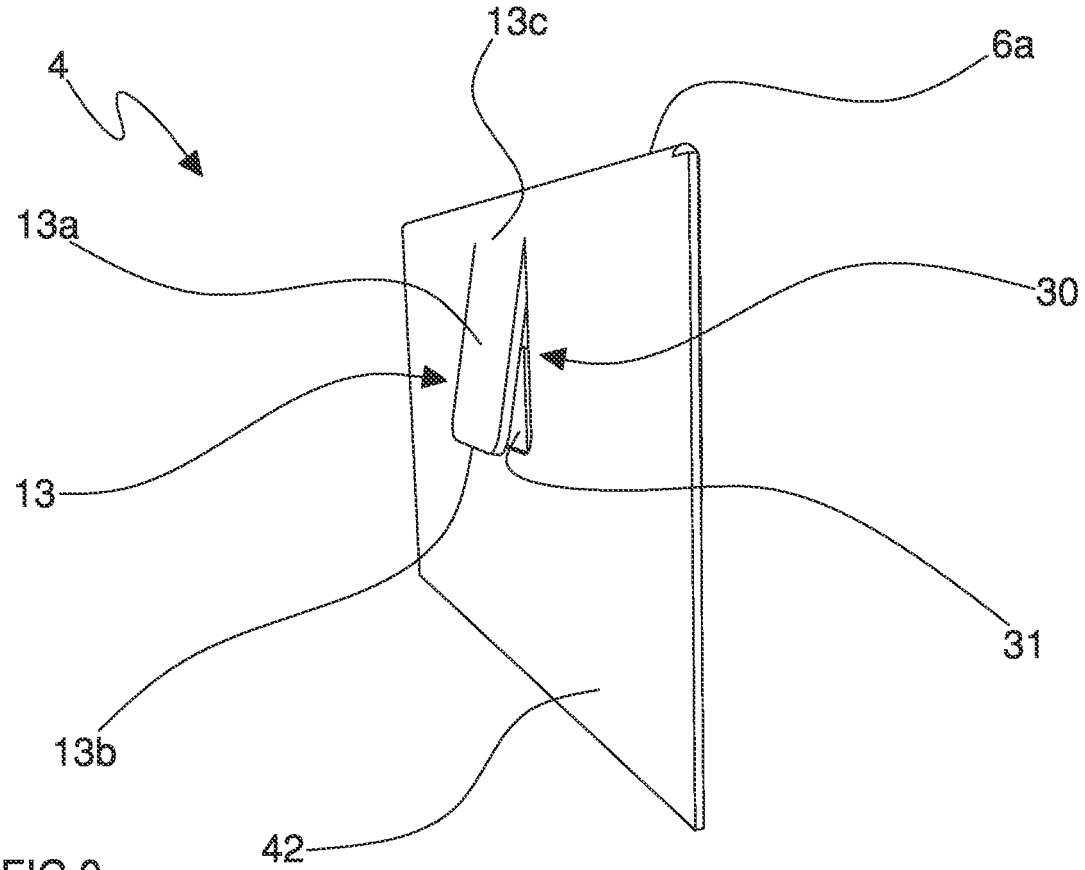
FIG.9

FIG.10
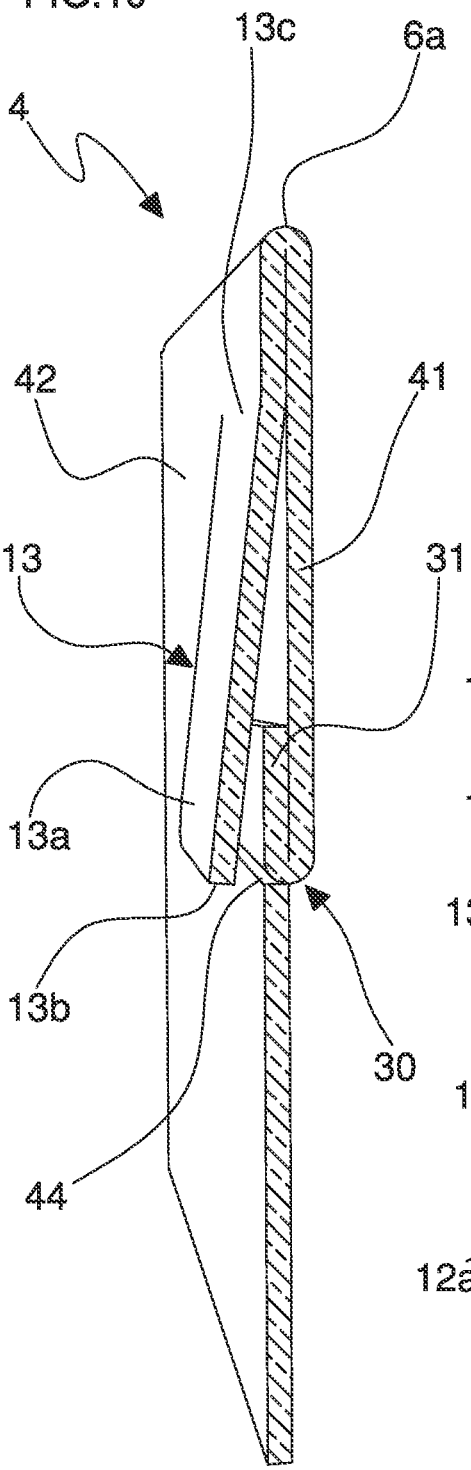
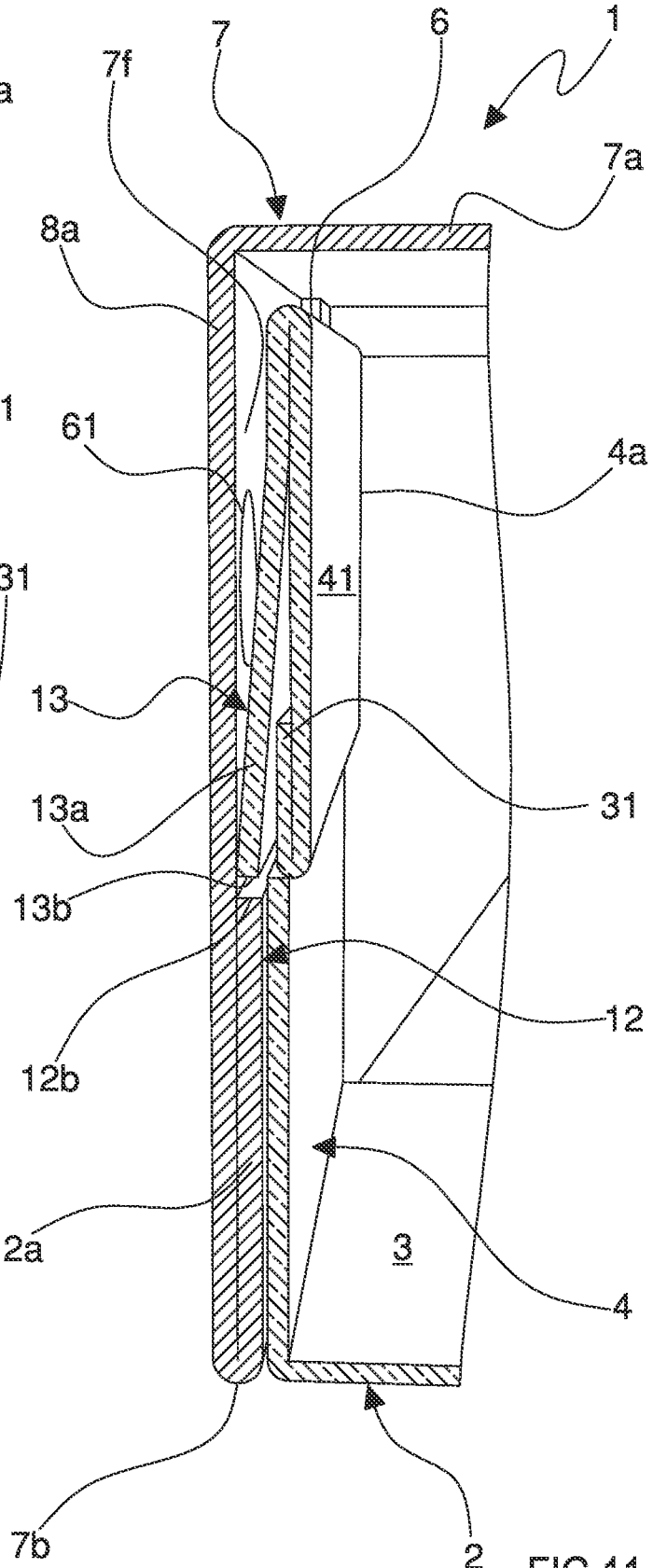
FIG.11

FIG.12
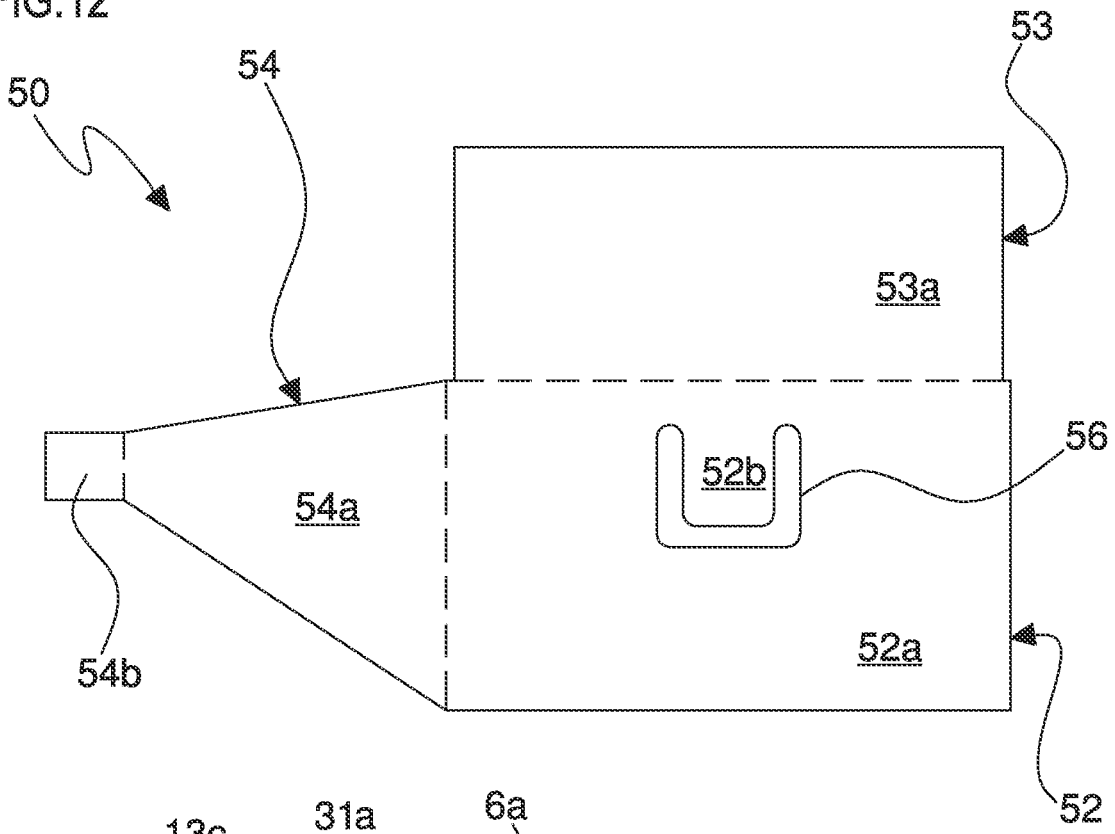
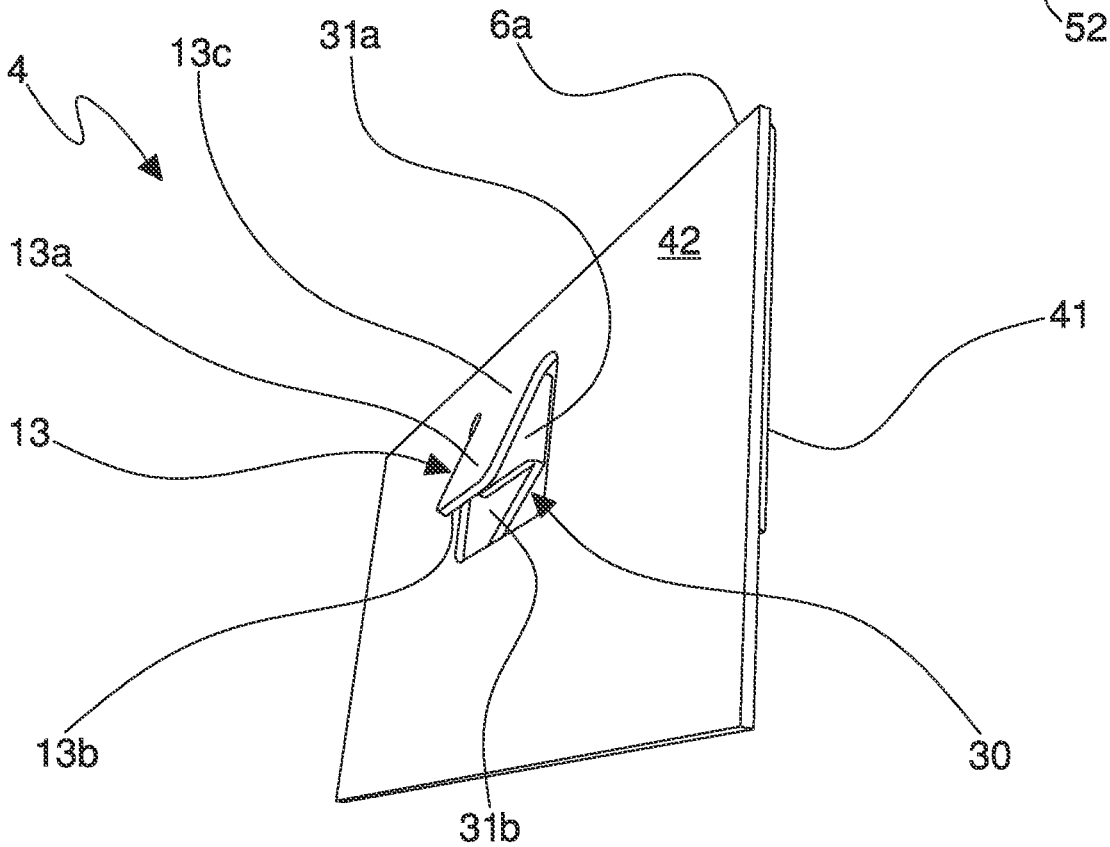
FIG.13

FIG.15
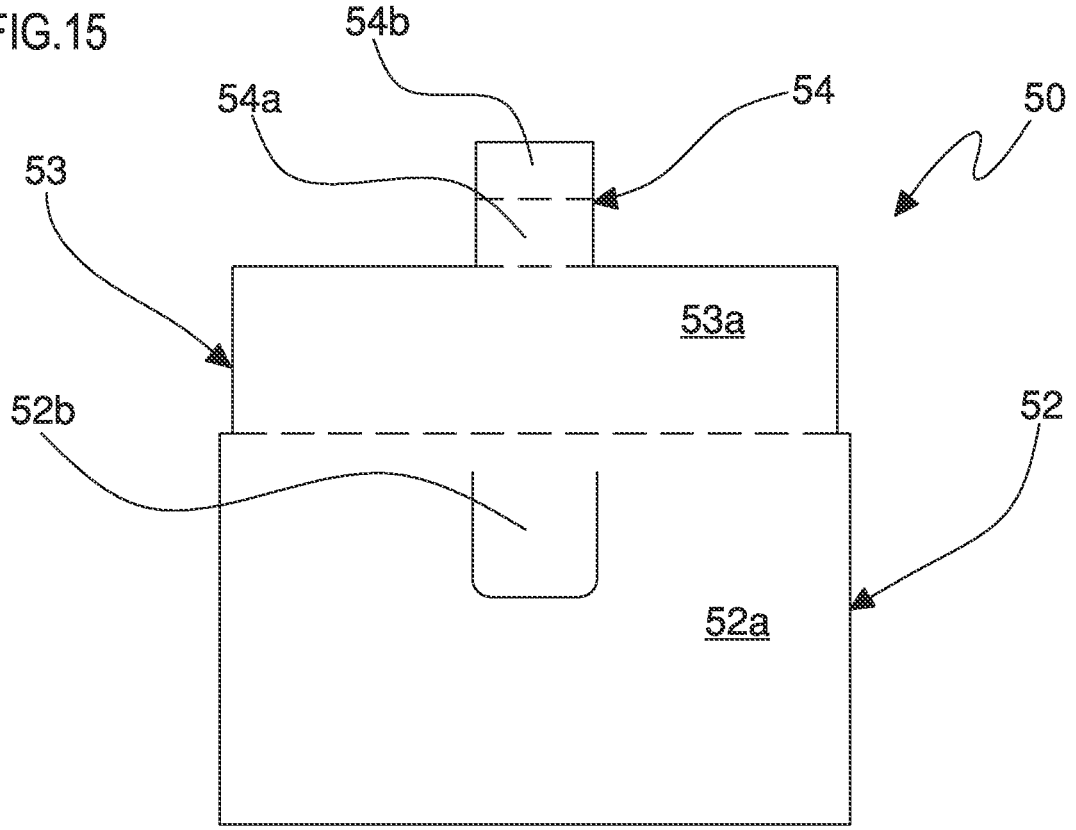
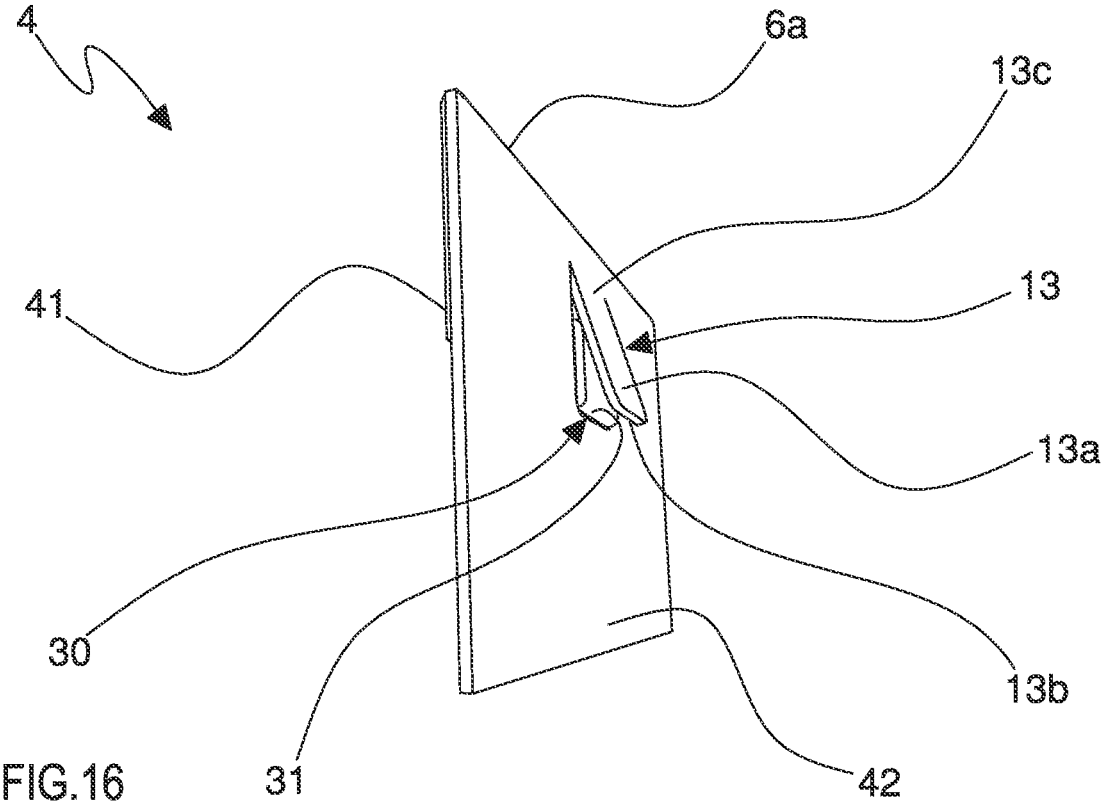
FIG.16

CHILD-PROOF CONTAINER AND PROCESS FOR MAKING THE SAME

RELATED APPLICATION

This application incorporates by reference in its entirety and claims priority to Italian patent application 102021000025892, filed Oct. 8, 2021.

FIELD OF THE INVENTION

The field of the present invention is that of child-proof containers and processes for making the same. The container may be employed for packaging drug products, cosmetics, cleaning products (detergents for linen and dishware), foods and tobacco-based products (cigars and cigarettes).

BACKGROUND

Packages made of paper material are known which are designed for being difficult for children to open for preventing these from coming into contact with products that are potentially damaging for them. A first type of child-proof package is described in the following documents: WO 2021/044266A1; US 2005/0173291A1; EP 2808265A1; U.S. Pat. No. 6,491,211B1; WO 2005/068304A2; US 2014/262839A1; EP 2810885A1; US 2012/234701A1; CN 204642380U; WO 2012/112538A1; WO 2009/038219A1; U.S. Pat. Nos. 1,253,489A; and 1,130,271. Such packages have a locking system which allows maintaining the same in a closed condition; the packages are openable due to the presence of a through access defined on a lateral wall of the package which allows a user to act, from outside the package, on the locking system.

A second type of package is described in the U.S. Pat. No. 9,475,605B2. Such package comprises a tray insertable in a casing; the tray has, at a top opening, two external locking tabs engageable in two respective lateral through openings of the casing in order to lock the package in a closed condition.

A third package example is described in the French patent application FR 783262A. Such package comprises a container having a top opening at which coupling tabs folded outside the package are present. The package is closeable by means of a lid having respective coupling portions suitable for being engaged with the folded tabs of the container for locking the package in the closed condition.

A fourth package example is described in the application of U.S. Pat. No. 2,559,320. Such package comprises a container having a top opening at which folded external edges are present; on each edge, a rectangular notch is present from which a further tab is obtained, folded above the respective edge. The notch defines an opening suitable for receiving in engagement a respective tab carried by a lid of the package; the engagement of the tab of the lid with the external edge of the container allows locking the package in a closed condition. The package is openable by inserting a finger below the lid, forcing the tab of the lid to exit from the notch defined on the folded edge of the container.

Even if the above-described known packages are employed today, the Applicant observed that such packages are not free of limitations and drawbacks, hence they can be improved with regard to several aspects.

SUMMARY

The invention may be embodied to solve the drawbacks and/or limitations of the preceding solutions. The invention may be embodied to provide a container that is extremely flexible in use, having a compact and extremely strong structure; in particular, the present invention may be embodied to provide a container having a stable structure capable of ensuring its own integrity following multiple uses. The present invention may also be embodied to provide a container capable of effectively preventing the opening of the same by children, but at the same time they can be easily openable by an adult. The present invention may be further embodied to provide a container having a simple and compact structure, manufacturable in a quick and inexpensive manner.

The present invention may be embodied as a child-proof container (1) comprising: a storage (2) defining a compartment (3) and having a lateral wall (4) defining a passage opening delimited by a free edge (6), said passage opening being configured for placing in communication the compartment (3) with the outside environment, a closure system (7) movable with respect to the storage (2) at least between: a closed condition where the closure system (7) prevents the communication between the compartment (3) and the outside environment, and an open condition where the closure system (7) allows the communication between the compartment (3) and the outside environment; at least one first coupling portion (12) carried by the closure system (7); and at least one second coupling portion (13) carried by the storage (2) and configured for cooperating with said first coupling portion (12), wherein the first and second coupling portions (12, 13), in the closed condition, are configured for being engaged with each other to define a locking condition of the container in which said first and second coupling portions (12, 13) prevent the closure system (7) from passing from the closed condition to the open condition. In one aspect according to the preceding aspect the second coupling portion (13) comprises at least one tab (13*a*) outside the compartment (3) and defining at least one undercut configured for engaging the first coupling portion (12) of the closure system (7) to define said locking condition.

The lateral wall (4) of the storage (2) may comprise at least one panel (41). In one aspect according to the preceding aspect the tab (13*a*) of the second coupling portion (13) emerges with respect to the panel (41) of the lateral wall (4) outside the compartment (3). In one aspect according to any one of the preceding aspects said tab (13*a*) of the second coupling portion (13) defines at least one undercut suitable for engaging the first coupling portion (12) of the closure system (7) to define said locking condition.

The tab (13*a*) of the second coupling portion (13), in the closed condition, may be movable at least between: a first operative position where at least one part of said tab (13*a*) is configured for engaging the first coupling portion (12), and a second operative position where said tab (13*a*) is configured for disengaging the first coupling portion (12) to allow the passage of the closure system (7) from the closed condition to the open condition.

At least one part of said tab (13*a*), in the first operative position, may be spaced from the panel (41) of the lateral wall (4). In one aspect according to any one of the two preceding aspects at least one part of said tab (13*a*), in the second operative position, is at a distance from the panel (41) of the lateral wall (4) lower than a distance between said panel (41) and said tab (13*a*), when said tab (13*a*) is in the first operative position.

The tab (13*a*) of the second coupling portion (13), in the first operative position, may be spaced from the panel (41) of the lateral wall (4). In one aspect according to any one of the preceding aspects the end portion of the tab (13*a*) of the second coupling portion (13), in the second operative position, is placed at a distance (optionally a maximum distance) from the panel (41) of the lateral wall (4) lower than a distance (optionally a maximum distance) between said panel (41) and said tab (13*a*), when said tab (13*a*) is in the first operative position. In one aspect according to any one of the preceding aspects, the end portion of the tab (13*a*) of the second coupling portion (13) defines said undercut.

The tab (13*a*) of the second coupling portion (13) may at least be partly delimited by a grip edge (13*b*). In one aspect according to the preceding aspect the grip edge (13*b*), defines at least part of the undercut of the second coupling portion (13). In one aspect according to any one of the two preceding aspects the grip edge (13*b*) is configured for engaging the first coupling portion (12) of the closure system (7) for defining said locking condition. In one aspect according to any one of the three preceding aspects the grip edge (13*b*) of the second coupling portion (13), in the first operative position, is spaced from the panel (41). In one aspect according to any one of the four preceding aspects, the grip edge (13*b*) of the second coupling portion (13), in the first operative position, is configured for engaging the first coupling portion (12). In one aspect according to any one of the preceding aspects the grip edge (13*b*) of the tab (13*a*) of the second coupling portion (13), in the second operative position, is placed at a distance (optionally a maximum distance) from the panel (41) of the lateral wall (4) lower than a distance (optionally a maximum distance) between said panel (41) and said grip edge (13*b*), when said tab (13*a*) is in the first operative position.

The tab (13*a*) of the second coupling portion (13) may integrally joined with the panel at an attachment edge (13*c*). In one aspect according to the preceding aspect the end portion of the tab (13*a*) of the second coupling portion (13) is opposite the attachment edge (13*c*). In one aspect according to any one of the two preceding aspects the grip edge (13*b*) of the tab (13*a*) is opposite the attachment edge (13*c*). In one aspect according to any one of the three preceding aspects the tab (13) of the second coupling portion (13), in the closed condition (optionally also in the locking condition), is movable between the first and the second operative position substantially around said attachment edge (13*c*).

The panel (41) may at least partly delimit the compartment (3) of the storage (2). The tab (13*a*) of the second coupling portion (13) may emerge (optionally at least in the first operative position) with respect to the panel (41) away from said compartment (3). In one aspect according to any one of the preceding aspects the tab (13*a*) of the second coupling portion (13) emerge (optionally at least in the first operative position) from the panel (41) away from the free edge (6) of the storage (2). In one aspect according to any one of the preceding aspects the tab (13*a*) is folded with respect to the panel (41). In one aspect according to any one of the preceding aspects the tab (13*a*) of the second coupling portion (13) is normally in the first operative position. In one aspect according to any one of the preceding aspects the tab (13*a*) of the second coupling portion (13), in the second operative position, is folded close to the panel (41).

In one aspect according to any one of the preceding aspects the first and second coupling portions (12, 13), in the locking condition, are engaged outside the compartment (3) of the storage (2). In one aspect according to any one of the preceding aspects the first and second coupling portions (12, 13), in the locking condition, are engaged (optionally entirely) in an internal volume (7*f*) of the closure system (7). In one aspect according to any one of the preceding aspects the undercut defined by the tab (13*a*) of the second coupling portion (13), in the closed condition and in the first operative position of the tab (13*a*), is engaged with the first coupling portion (12) to define said locking condition.

In one aspect according to any one of the preceding aspects the container (1) comprises at least one spacer (30) at least partly interposed between the tab (13*a*) of the second coupling portion (13) and the lateral wall (4) of the storage (2). In one aspect according to the preceding aspect the spacer (30) is at least partly interposed between the tab (13*a*) of the second coupling portion (13) and the panel (41) of the lateral wall (4). In one aspect according to the preceding aspect the spacer (30) is configured for preventing the contact between the grip edge (13*b*) of the second coupling portion (13) with the panel (41) of the storage (2). In one aspect according to any one of the two preceding aspects the spacer (30), at least in the closed condition, is configured for spacing at least one part of the tab (13*a*) (optionally the end portion of the tab 13*a*) of the second coupling portion (13) suitable for defining said undercut from the panel (41) of the lateral wall (4). In one aspect according to any one of the preceding aspects the spacer (30) is spaced from the free edge (6) of the storage.

In one aspect according to any one of the preceding aspects the spacer (30) comprises at least one auxiliary tab (31) made of sheet material. In one aspect according to any one of the preceding aspects the auxiliary tab (31) of the spacer (30) is integrally joined with at least one of said panel (41) and of the lateral wall (4) and the tab (13*a*) of the second coupling portion (13). In one aspect according to any one of the preceding aspects the auxiliary tab (31) of the spacer (30) and the tab (13*a*) of the second coupling portion (13) are facing and both spaced from the free edge (6) of the storage (2).

In one aspect according to any one of the preceding aspects the auxiliary tab (31) is at least partly facing the tab (13*a*) of the second coupling portion (13), optionally the auxiliary tab faces the end portion of the tab of the second coupling portion. In one aspect according to any one of the preceding aspects the auxiliary tab (31) is at least partly in contact with the tab (13*a*) of the second coupling portion (13). In one aspect according to any one of the preceding aspects the auxiliary tab (31) is at least partly in contact with the end portion of the tab (13*a*) of the second coupling portion (13).

In one aspect according to any one of the preceding aspects the auxiliary tab (31) is integrally joined with the tab (13*a*) of the second coupling portion (13). In one aspect according to any one of the preceding aspects the auxiliary tab (31) of the spacer (30) is integrally joined with the tab (13*a*) of the second coupling portion (13) at the end portion. In one aspect according to any one of the preceding aspects the auxiliary tab (31) of the spacer (30) is integrally joined with the grip edge (13*b*) of the second coupling portion (13). In one aspect according to any one of the preceding aspects the auxiliary tab (31) is overlapped to the tab (13*a*) of the second coupling portion (13). In one aspect according to any one of the preceding aspects the auxiliary tab (31) is folded with respect to the tab (13*a*) of the second coupling portion (13) starting from the grip edge (13*b*). In one aspect according to any one of the preceding aspects the auxiliary tab (31) is extended substantially parallel to the section of the tab (13*a*) of the second coupling portion (13) directly facing said auxiliary tab.

In one aspect according to any one of the preceding aspects the auxiliary tab (31) is constrained to the tab (13*a*) of the second coupling portion (13). In one aspect according to any one of the preceding aspects the spacer (30), optionally the auxiliary tab (31) of said spacer, is glued to the tab (13*a*) of the second coupling portion (13). In one aspect according to any one of the preceding aspects the spacer (30) is configured for being moved together with the tab (13*a*) between the first and the second operative position, and vice versa. In one aspect according to any one of the preceding aspects the auxiliary tab (31) of the spacer, in the open condition, is extended parallel to the tab (13*a*) of the second coupling portion (13).

In one aspect according to any one of the preceding aspects the spacer (30), optionally the auxiliary tab (31) of said spacer (30), is constrained to the lateral wall of the storage. In one aspect according to any one of the preceding aspects the auxiliary tab (31) of the spacer (30) is glued to the lateral wall of the storage. In one aspect according to any one of the preceding aspects the auxiliary tab (31) of the spacer (30) is glued to the panel (41) of the lateral wall (4) of the storage. In one aspect according to any one of the preceding aspects the auxiliary tab (31) of the spacer (30), in the open condition, is extended parallel to the panel (41) of the lateral wall (4), directly carrying said spacer (30).

In one aspect according to any one of the preceding aspects the auxiliary tab (31) is folded with respect to the tab (13*a*) of the second coupling portion (13) at the end portion (optionally at the grip edge 13*b*) to define a return element. In one aspect according to any one of the preceding aspects the defined return element of the auxiliary tab (31), at least in the second operative position, is configured for contacting the panel (41) of the lateral wall, optionally to push the tab (13*a*) of the second coupling portion (13) in the first operative position. In one aspect according to any one of the preceding aspects the auxiliary tab (31) is configured for forcing the tab (13*a*) of the second coupling portion to maintain the first operative position. In one aspect according to any one of the preceding aspects the auxiliary tab (31) is configured for defining an elastic return element made of sheet material. In one aspect according to any one of the preceding aspects the auxiliary tab (31) is integrally joined with the tab (13*a*) of the second coupling portion (13) and defines, with said tab (13*a*), a single folded tab. In one aspect according to the preceding aspect said single folded tab (optionally said single tab is defined by the tab 13*a* and by the auxiliary tab 31) is configured for normally maintaining a substantially "V"-shaped conformation. In one aspect according to any one of the two preceding aspects said single tab is configured for forcing the tab (13*a*) of the second coupling portion (optionally at least in the closed condition) to maintain the first operative position. In one aspect according to any one of the three preceding aspects said single tab, in the closed condition of the container, has a substantially "V"-shaped profile. In one aspect according to any one of the four preceding aspects the auxiliary tab (31) of the spacer, at least in the closed condition (optionally in the locking condition) is tilted with respect to the tab (13*a*) of the second coupling portion (13). In one aspect according to any one of the five preceding aspects said single tab is configured for forcing the tab (13*a*) of the second coupling portion (13) itself to maintain the first operative position.

In one aspect according to any one of the preceding aspects the auxiliary tab (31) is carried by the panel (41) of the lateral wall (4). In one aspect according to any one of the preceding aspects the auxiliary tab (31) is facing and at least partly in contact with the panel (41). In one aspect according to any one of the preceding aspects the auxiliary tab (31) is integrally joined with the panel (41). In one aspect according to any one of the preceding aspects the auxiliary tab (31) emerges from the panel (41) towards the tab (13*a*) of the second coupling portion (13). In one aspect according to any one of the preceding aspects the auxiliary tab (31) is overlapped to the panel (41). In one aspect according to any one of the preceding aspects the auxiliary tab (31) is constrained to the panel (41), optionally by means of gluing. In one aspect according to any one of the preceding aspects the auxiliary tab (31) lies on a plane parallel to a lying plane of the panel (41). In one aspect according to any one of the preceding aspects the auxiliary tab (31) is folded with respect to the panel (41) to define a return element. In one aspect according to any one of the preceding aspects the return element defined by the auxiliary tab (31), at least in the second operative position of the tab (13*a*) of the second coupling portion (13), is configured for contacting said tab (13*a*) of the second coupling portion (13) for pushing it into the first operative position. In one aspect according to any one of the preceding aspects the auxiliary tab (31) is configured for forcing the tab (13*a*) of the second coupling portion to maintain the first operative position. In one aspect according to any one of the preceding aspects the auxiliary tab (31) of the spacer (30) is configured for defining an elastic return element made of sheet material. In one aspect according to any one of the preceding aspects the auxiliary tab (31) defines with the panel (41) a single body configured for normally maintaining, in the closed condition of the container, a substantially "V"-shaped conformation suitable for forcing the first operative position of the tab (13*a*) of the second coupling portion (13).

In one aspect according to any one of the preceding aspects the auxiliary tab (31) of the spacer (30) has a substantially rectangular shape or substantially a trapezium shape.

In one aspect according to any one of the preceding aspects the spacer (30) comprises a first and a second auxiliary tab (31*a*, 31*b*) overlapped to each other. In one aspect according to the preceding aspect the first and second auxiliary tabs are engaged to the panel (41). In one aspect according to the two preceding aspects the second auxiliary tab (31*b*) is interposed between the panel (41) and the first auxiliary tab (31*a*). In one aspect according to the three preceding aspects, the first and second auxiliary tabs (31*a*, 31 *b*) are in contact and joined by means of gluing. In one aspect according to the four preceding aspects the first and second auxiliary tabs (31*a*, 31*b*) are overlapped. In one aspect according to the five preceding aspects the first and second auxiliary tabs (31*a*, 31*b*) lie on respective ideal planes that are substantially parallel to each other. In one aspect according to the six preceding aspects the first and second auxiliary tabs (31*a*, 31*b*) are integrally joined to the panel (41) and folded with respect to said panel (41).

In one aspect according to any one of the preceding aspects the storage (2) comprises a bottom wall (4*f*) from which the lateral wall of the storage (2) emerges away therefrom. In one aspect according to any one of the preceding aspects the storage (2) has only one passage opening opposite the bottom wall (4*f*).

In one aspect according to any one of the preceding aspects the lateral wall (4) of the storage (2) comprises at least one front wall (4*a*) and at least one opposite rear wall (4*b*) connected by means of at least one first and at least one second lateral wall (4*c*, 4*d*). In one aspect according to any one of the preceding aspects the lateral wall (4) of the storage (2) comprises at least one first and one second panel (41, 42) facing and engaged with each other. In one aspect according to any one of the preceding aspects the first and second panels (41, 42) are integrally joined at a folding edge and facing each other to define a folded portion. In one aspect according to any one of the preceding aspects the first and second panels (41, 42) are overlapped. In one aspect according to any one of the preceding aspects the first and second panels (41, 42) lie on substantially parallel ideal planes.

In one aspect according to any one of the preceding aspects the first panel (41) defines at least one part of an internal surface delimiting a part of the compartment (3) of the storage (2). In one aspect according to any one of the preceding aspects the second panel (42) defines at least one part of an external surface of the storage (2), optionally opposite an internal surface delimiting the compartment (3) of the storage (2).

In one aspect according to any one of the preceding aspects the second coupling portion (13) is carried by the second panel. In one aspect according to any one of the preceding aspects the tab (13*a*) of the second coupling portion (13) is made on the second panel (42). In one aspect according to any one of the preceding aspects the second coupling portion (13) is made via notching of the second panel (42). In one aspect according to any one of the preceding aspects the second panel (42) comprises a seat (43) delimited by a perimeter edge (44), in which said spacer (30) is at least partly arranged in said seat (43). In one aspect according to any one of the preceding aspects the tab (13*a*) of the second coupling portion (13) emerges from the second panel (42) away from the first panel (41). In one aspect according to any one of the preceding aspects the tab (13*a*) of the second coupling portion (13) faces the seat (43).

In one aspect according to any one of the preceding aspects the tab (13*a*) of the second coupling portion (13) is integrally joined with the second panel (42) by means of an attachment edge (13*c*). In one aspect according to the preceding aspect the end portion of the tab (13*a*) of the second coupling portion (13) is opposite the attachment edge (13*c*). In one aspect according to any one of the two preceding aspects the grip edge (13*b*) of the tab (13*a*) is opposite the attachment edge (13*c*). In one aspect according to any one of the preceding aspects the attachment edge (13*c*) is spaced from the free edge (6) of the storage (2). In one aspect according to any one of the preceding aspects the auxiliary tab (31), at least in the second operative position of the tab (13*a*) of the second coupling portion (13), is arranged at least in part in the seat (43). In one aspect according to any one of the preceding aspects the auxiliary tab (31) is configured for obstructing the insertion of the tab (13*a*) of the second coupling portion (13) in the seat (43) of the second panel (42). In one aspect according to any one of the preceding aspects the auxiliary tab (31) is configured for preventing the complete insertion of the tab (13*a*) of the second coupling portion (13) in the seat (43) of the second panel (42).

In one aspect according to any one of the preceding aspects the tab (13*a*) of the second coupling portion (13) is movable between the first and the second operative position substantially around the attachment edge (13*c*). In one aspect according to any one of the preceding aspects the tab (13*a*) of the second coupling portion (13) is movable close to and away from the first panel (41). In one aspect according to any one of the preceding aspects the spacer (30)—optionally the auxiliary tab (31) of the spacer (30)—is configured for maintaining a predetermined distance between the first panel (41) and the tab (13*a*) of the second coupling portion (13). In one aspect according to any one of the preceding aspects the spacer (30)—optionally the auxiliary tab (31) of the spacer (30)—is configured for maintaining a predetermined distance between the first panel (41) and the end portion of the tab (13*a*) of the second coupling portion (13).

In one aspect according to any one of the preceding aspects the tab (13*a*) projects from the lateral wall (4) of the storage (2) to which said tab (13*a*) is integrally joined, according to a sense exiting from the compartment (3). In one aspect according to any one of the preceding aspects the tab (13*a*) of the second coupling portion (13), both in the first and in the second operative position, at least partly projects from the lateral wall (4) to which said tab (13*a*) is integrally joined, according to a sense exiting from the compartment (3). In one aspect according to any one of the preceding aspects the tab (13*a*) of the second coupling portion (13), both in the first and in the second operative position, at least partly projects from the second panel (42) of the lateral wall (4) with which said tab (13*a*) is integrally joined, according to a sense exiting from the compartment (3).

In one aspect according to any one of the preceding aspects the tab (13*a*) of the second coupling portion (13) has a substantially rectangular or triangular shape, or substantially a trapezium shape, or "V"-shaped shape or "C"-shaped shape. In one aspect according to any one of the preceding aspects at least one section of the grip edge (13*b*) of the tab (13*a*) of the second coupling portion (13) is tilted with respect to the free edge (6) of the passage opening of the storage (2). In one aspect according to any one of the preceding aspects at least one section of the grip edge (13*b*) of the tab (13*a*) is tilted with respect to the free edge (6) by an angle comprised between 20° and 80°, still more optionally by an angle comprised between 30° and 70°. In one aspect according to any one of the preceding aspects the tab (13*a*) of the second coupling portion (13) is tilted with respect to the lateral wall of the storage (2) to which it is engaged by an angle comprised between 1° and 30°; optionally said angle being measured between facing surfaces of the tab (13*a*) and of the lateral wall of the storage (2) directly carrying (optionally integrally joined) said panel (13*a*).

In one aspect according to any one of the preceding aspects the tab (13*a*) of the second coupling portion (13), both in the first and in the second operative position, is tilted with respect to the panel (41). In one aspect according to any one of the preceding aspects the tab (13*a*) of the second coupling portion (13), in the second operative position, is tilted with respect to the first panel (41) by an angle greater than 1°, optionally comprised between 2° and 15°. In one aspect according to any one of the preceding aspects the tab (13*a*) of the second coupling portion (13), in the first operative position, is tilted with respect to the first panel (41) by an angle greater than an angle subtended by the same first panel (41) and by the same tab (13*a*) when said tab is in the second operative position.

In one aspect according to any one of the preceding aspects the spacer (30), optionally the auxiliary tab (31), is configured for maintaining tilted the tab (13*a*) of the second coupling portion (13) with respect to the panel, optionally with respect to the first panel (41). In one aspect according to any one of the preceding aspects the second coupling portion (13) of the storage (2) is defined in interposition between the bottom wall (4*f*) and the free edge (6) of the storage (2).

In one aspect according to any one of the preceding aspects the container comprises at least two second coupling portions (13). In one aspect according to any one of the preceding aspects the container comprises a second coupling portion (13) carried by the front wall (4*a*) of the storage (2)

and a second coupling portion (13) carried by the rear wall (4*b*) of the storage (2). In one aspect according to any one of the preceding aspects at least the front wall (4*a*) comprises the panel (41), the second coupling portion (13) and the spacer (30). In one aspect according to any one of the preceding aspects at least one of said front wall (4*a*) and rear wall (4*b*) of the storage (2) comprises the panel (41), the second coupling portion (13) and the spacer (30).

In one aspect according to any one of the preceding aspects the closure system (7) is engaged at the free edge (6) of the storage (2) and movable via rotation, relative to said storage (2), between the open condition and the closed condition, and vice versa. In one aspect according to any one of the preceding aspects the closure system (7) is hinged to the free edge (6) of the storage. In one aspect according to any one of the preceding aspects the closure system (7) comprises at least one top wall (7*a*) engaged with the free edge (6) of the storage (2) and at least one coupling portion configured for being flanked, in the closed condition, the lateral wall of the storage (2). In one aspect according to any one of the preceding aspects the top portion (7*a*) of the closure system (7) defines a closure wall of the container (1) configured for obstructing, in the closed condition, the passage opening.

In one aspect according to any one of the preceding aspects the closure system (7) comprises a front wall (8*a*) emerging from the top wall (7*a*), wherein the closure system (7) also comprises a first and a second lateral wall (8*c*, 8*d*), opposite each other, also emerging from the top wall (7*a*) from the same side as the front wall (8*a*), wherein the first and second lateral walls (8*c*, 8*d*) of the closure system (7) are connected to each other by means of the front wall (8*a*) of the same closure system (7). In one aspect according to any one of the preceding aspects the closure system delimits an internal volume (7*f*). In one aspect according to any one of the preceding aspects the front wall (8*a*), the first lateral wall (8*c*) and the second lateral wall (8*d*) together with the top wall (7*a*) of the closure system (7) delimit an internal volume (7*f*) suitable for housing, in the closed condition, at least partly the storage (2). In one aspect according to any one of the preceding aspects in the closed condition of the container (1): the front walls (4*a*, 8*a*) respectively of the storage and of the closure system are directly facing each other, the first lateral walls (4*c*, 8*c*) respectively of the storage and of the closure system are directly facing each other, and the second lateral walls (4*b*, 8*d*) respectively of the storage and of the closure system are directly facing each other.

In one aspect according to any one of the preceding aspects the top wall (7*a*) of the closure system (7), in the closed condition, is configured for contacting and being abutted against at least one part of the free edge (6) of the storage (2).

In one aspect according to any one of the preceding aspects the closure system (7) is distinct and completely separable from the storage (2). In one aspect according to any one of the preceding aspects the closure system (7) is movable at least between: a closed condition of the container wherein the closure system (7) itself prevents the communication between the compartment (3) of the storage (2) and the outside environment, and an open condition of the container wherein the closure system (7) is completely separate of the storage and allows the communication between the compartment (3) and the outside environment.

In one aspect according to any one of the preceding aspects the closure system (7) comprises a top wall (7*a*) and a predetermined number of lateral walls emerging from the top wall (7*a*) to define an internal volume (7*f*) suitable for housing, in the closed condition of the closure system (7), at least partly the storage (2). In one aspect according to any one of the preceding aspects the closure system (7) is at least partly countershaped with respect to the storage (2).

In one aspect according to any one of the preceding aspects the closure system (7) comprises a front wall (8*a*) and a rear wall (8*b*) opposite the front wall (8*a*), the closure system (7) also comprising a first and a second lateral wall (8*c*, 8*d*), also opposite to each other and connecting the front wall (8*a*) and the rear wall (8*b*). In one aspect according to any one of the preceding aspects the front wall (8*a*), the rear wall (8*b*), the first lateral wall (8*c*) and the second lateral wall (8*d*) of the closure system (7) delimit, in cooperation with the top wall (7*a*), the internal volume (7*f*) of the closure system (7) suitable for housing, in the closed condition, at least part of the storage (2). In one aspect according to any one of the preceding aspects the free edge (6) of the storage (2) is configured for entering at least partly in contact with the top wall (7*a*) of the closure system, in the closed condition of the container.

In one aspect according to any one of the preceding aspects the front wall (8*a*), the rear wall (8*b*), the first lateral wall (8*c*) and the second lateral wall (8*d*) of the closure system (7) define an access delimited by a respective free edge (7*b*) and configured for allowing the passage of the storage during the passage from the open condition to the closed condition of the container (1).

In one aspect according to any one of the preceding aspects in the closed condition: the front walls (4*a*, 8*a*) respectively of the storage and of the closure system are directly facing each other, the rear walls (4*b*, 8*b*) respectively of the storage and of the closure system are directly facing each other, the first lateral walls (4*c*, 8*c*) respectively of the storage and of the closure system are directly facing each other, and the second lateral walls (4*b*, 8*d*) respectively of the storage and of the closure system are directly facing each other.

In one aspect according to any one of the preceding aspects the predetermined number of lateral walls of the closure system (7) is at least partly counter-shaped with respect to the predetermined number of lateral walls of the storage (2).

In one aspect according to any one of the preceding aspects the first coupling portion (12) is carried by at least one lateral wall of the closure system (7). In one aspect according to any one of the preceding aspects the first coupling portion (12) is carried at least by the front wall (8*a*) of the closure system (7). In one aspect according to any one of the preceding aspects the first coupling portion (12) is carried by the front wall (8*a*) and by the rear wall (8*b*) of the closure system (7).

In one aspect according to any one of the preceding aspects the first coupling portion (12) is entirely arranged in the internal volume (7*f*) of the closure system (7). In one aspect according to any one of the preceding aspects the first coupling portion (12) is spaced from the free edge (7*b*) of the closure system (7). In one aspect according to any one of the preceding aspects the first coupling portion (12) is interposed between the top wall (7*a*) and the free edge (7*b*) of the closure system (7).

In one aspect according to any one of the preceding aspects the first coupling portion (12) comprises at least one tab (12*a*) carried by at least one lateral wall of the closure system (7). In one aspect according to any one of the preceding aspects the tab (12*a*) defines an undercut delimited by at least one grip edge (12*b*), separate and spaced from the free edge (7*b*) of the closure system (7). In one aspect according to any one of the preceding aspects the first coupling portion (12) is integrally joined with at least one lateral wall of the closure system. In one aspect according to any one of the preceding aspects the first coupling portion (12) is integrally joined with at least one lateral wall of the closure system by means of a folding edge to define a folded portion in the internal volume (7*f*) of the same closure system. In one aspect according to any one of the preceding aspects the folding edge between the first coupling portion (12) and the lateral wall with which said portion is integrally joined, defines at least one part of the free edge (7*b*) of the access of the closure system. In one aspect according to any one of the preceding aspects the closure system has a first coupling portion (12) carried by the front wall (8*a*) of the closure system (7) and a further first coupling portion (12) carried by the rear wall (8*b*) of the closure system (7). In one aspect according to any one of the preceding aspects the grip edge (12*b*) of each first coupling portion (12) is in interposition between the top wall (7*a*) and the free edge (7*b*) of the closure system (7). In one aspect according to any one of the preceding aspects the tab (12*a*) of each first coupling portion (12) emerges into the compartment of the closure system (7). In one aspect according to any one of the preceding aspects the tab (12*a*) of each first coupling portion (12) extends substantially parallel to the lateral wall directly carrying said tab (12*a*).

In one aspect according to any one of the preceding aspects the second coupling portion (13) carried by the front wall (4*a*) of the storage (2), in the closed condition, is configured for being engaged with the first coupling portion (12) carried by the front wall (8*a*) of the closure system (7) to define said locking condition. In one aspect according to any one of the preceding aspects the second coupling portion (13) carried by the rear wall (4*b*) of the storage (2), in the closed condition of the container (2), is configured for being engaged with the first coupling portion (12) carried by the rear wall (8*b*) of the closure system (7) to define said locking condition.

In one aspect according to any one of the preceding aspects the container comprises a second coupling portion (13) for each first coupling portion (12) on the closure system (7). In one aspect according to any one of the preceding aspects the two second coupling portions (13) are engaged with respective lateral walls of the storage (2) that are opposite each other.

In one aspect according to any one of the preceding aspects at least one between the closure system (7) and the storage (2) comprises at least one unlocking portion (60) configured for allowing, at least in the locking condition, the disengagement between the first coupling portion (12) and the second coupling portion (13).

In one aspect according to any one of the preceding aspects the unlocking portion (60) is configured to define at least one through access (61) on at least one lateral wall of the closure system (7). In a further aspect according to any one of the preceding aspects the unlocking portion (60) is configured for allowing, at least in the locking condition, intervention—manually and/or by means of an opening device—from outside the container on at least one between said first and second coupling portions (12, 13) to allow the disengagement thereof and hence allow the passage of closure system (7) and storage (2) from the closed condition to the open condition. In one aspect according to any one of the preceding aspects the unlocking portion (60), in the locking condition, is arranged at the first and second coupling portions (12, 13). In one aspect according to any one of the preceding aspects the unlocking portion (60) comprises at least one through access (61) defined on at least one lateral wall of the closure system (7). In one aspect according to any one of the preceding aspects the unlocking portion (60), optionally the through access (61), is configured for allowing, at least in the locking condition, intervention (optionally manually and/or by means of an opening device) from outside the container (1) directly on the second coupling portion (13) at least partly facing said through access.

In one aspect according to any one of the preceding aspects the container comprises an unlocking portion (60) defined on the front wall (8*a*) of the closure system (7) and configured for allowing a user to intervene manually directly on the panel (13*a*) of the second coupling portion (13) defined on the front wall (4*a*) of the storage to allow the disengagement thereof with the tab (12*a*) of the first coupling portion (12) defined on the front wall (8*a*) of the closure system (7). In one aspect according to any one of the preceding aspects the through access (61) of the unlocking portion is defined on the front wall (8*a*) of the closure system (7). In one aspect according to any one of the preceding aspects the unlocking portion (60) is defined at the grip edge (12*b*) of the first coupling portion (12). In one aspect according to any one of the preceding aspects the second coupling portion (13), optionally the tab (13*a*) of the second coupling portion (13), carried by the front wall of the storage (2) is interposed—in the locking condition—between the unlocking portion (60) and the first coupling portion (12) carried by the front wall (8*a*) of the closure system (7).

An aspect concerns a process of making a container (1) according to any one of the preceding aspects. In one aspect according to the preceding aspect the storage is made by folding of a blank (50) made of flat sheet. In one aspect according to the two aspects preceding the blank (50) is made of paper sheet material. In one aspect according to any one of the preceding aspects of the process, the blank (50) is made by means of die cutting of a flat semi-finished sheet.

In one aspect according to any one of the preceding aspects of the process, the closure system (7) is made by folding a flat blank sheet. In one aspect according to any one of the preceding aspects of the process, the blank is made of paper sheet material. In one aspect according to any one of the preceding aspects of the process, the blank (50) is made by means of die cutting of a flat semi-finished sheet.

In one aspect according to any one of the preceding aspects of the process, the blank for making the storage (2) is separate and distinct from the blank used for making the closure system.

In one aspect according to any one of the preceding aspects of the process, the blank for making the storage comprises: at least one central sheet, at least one lateral sheet (52) integrally joined with and emerging from the central sheet, and at least one auxiliary sheet (54) spaced from the central sheet, wherein the process comprises the steps of: folding the lateral sheet (52) with respect to the central sheet to define the panel (41) of the storage (2) and the second coupling portion (13), and arranging the auxiliary sheet (54) at least partly in interposition between the second coupling portion (13) and the panel (41) to define the spacer (30).

In one aspect according to the preceding aspect the blank (50) comprises a second lateral sheet (53) integrally joined with the first lateral sheet (52) and emerging from said first lateral sheet on the opposite side with respect to the central sheet, in which the auxiliary sheet is integrally joined directly to at least one of said first and second lateral sheets, wherein the folding step of the process comprises folding the first and second lateral sheets with respect to the central sheet to define respectively the first and second panels (41, 42) of the lateral wall of the storage, optionally the central sheet, following the folding step, defines the bottom wall (4*f*) of the storage (2).

In one aspect according to any one of the preceding aspects of the process, the first lateral sheet comprises a first portion (52*a*) suitable for defining the second panel (42) of the lateral wall of the storage (2) and at least one second portion (52*b*) configured for defining the tab (13*a*) of the second coupling portion (13). In one aspect according to any one of the preceding aspects of the process the second lateral sheet (53) comprises a single portion (53*a*) configured for defining the first panel (41) of the lateral wall of the storage (2). In one aspect according to any one of the preceding aspects of the process the first portion (52*a*) of the first lateral wall (52) comprises a notch (56) suitable for defining the seat (44) of the second panel (42) and from which the second portion (52*b*) is obtained. In one aspect according to any one of the preceding aspects of the process the auxiliary sheet (54) comprises at least one first portion (54*a*) integrally joined with at least one of: the first portion (52*a*) of the first lateral sheet (52), the second portion (52*b*) of the first lateral sheet (52), the second lateral sheet (53).

In one aspect according to any one of the preceding aspects of the process, the auxiliary sheet (54) comprises a first and a second portion (54*a*, 54*b*) that are integrally joined, the process comprising a step of folding the blank in a manner such that said first and second portions (54*a*, 54*b*) of the auxiliary sheet (54) may define the first and second auxiliary tabs (31*a*, 31*b*) of the spacer (30).

In one aspect a use of the container (1) is provided according to any one of the preceding aspects for containing at least one of the following products: drugs, cosmetics, cleaning products (e.g. detergents for linen and dishware), foods and tobacco-based products (e.g. cigar and cigarettes).

SUMMARY OF THE DRAWINGS

Several embodiments and several aspects of the finding will be described herein below with reference to the enclosed drawings, provided only as a non-limiting example in which:

FIG. 1 shows a blank for making a wall of a container according to the present invention;

FIG. 2 is a perspective view of a wall of a container according to the present invention, made by means of the blank of FIG. 1;

FIG. 3 is a sectional detailed view of the wall of FIG. 2;

FIG. 4 is a sectional detailed view of a container according to the present invention, arranged in a locking condition;

FIG. 5 is a perspective view of a container according to the present invention comprising the wall of FIG. 2;

FIG. 6 is a perspective view of a closure system of a container according to the present invention;

FIG. 8 shows a further blank for making at least one wall of a container according to the present invention;

FIG. 9 is a perspective view of a wall of a container according to the present invention, made by means of the blank of FIG. 8;

FIG. 10 is a sectional detailed view of the wall of FIG. 9;

FIG. 11 is a sectional detailed view of a further container according to the present invention, arranged in a locking condition;

FIG. 12 shows a further blank for making at least one wall of a container according to the present invention;

FIG. 13 is a perspective view of a wall of a container according to the present invention, made by means of the blank of FIG. 12;

FIG. 15 shows a further blank for making at least one wall of a container according to the present invention;

FIG. 16 is a perspective view of a wall of a container according to the present invention, made by means of the blank of FIG. 12.

DETAILED DESCRIPTION

Figure 7:
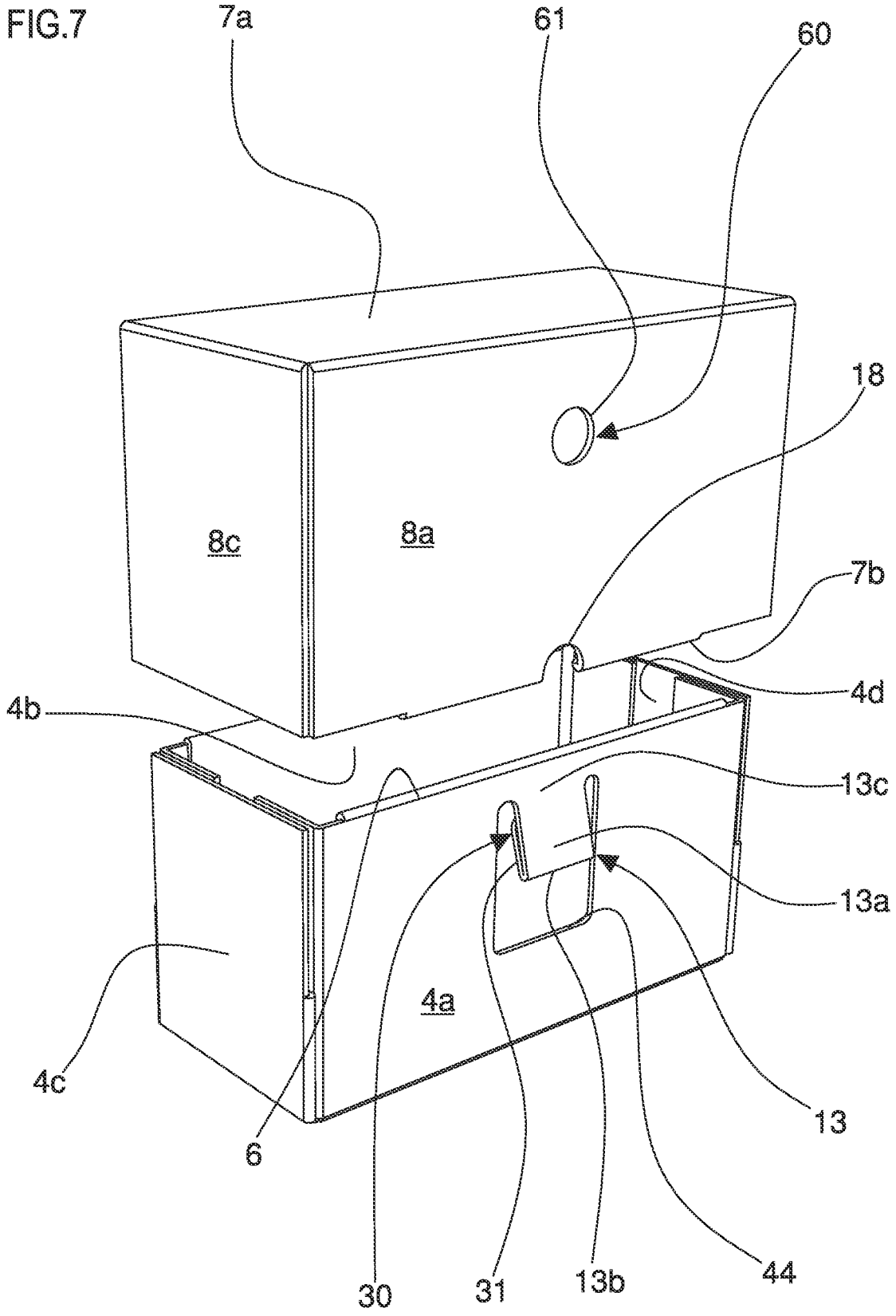
FIG. 7 is a perspective view of a container according to the present invention.

In the present detailed description, corresponding parts illustrated in the various figures are indicated with the same numeric references. The figures could illustrate the object of the invention by means of representations that are not in scale; therefore, parts and components illustrated in the figures relative to the object of the invention might only regard schematic representations.

With the term "product" it is intended an article or a compound of articles of any kind. For example, the product may also be intended as a package, e.g. a blister, carrying a plurality of articles. The product may comprise: drugs, cosmetic products, capsules for dishwashers and washing machines, products for cleaning the home and linen (e.g. detergents), foods and cigarettes.

With the term "paper material" it is intended paper or cardboard, optionally having at least 50% by weight, optionally at least 70% by weight, of organic material comprising one or more from among cellulose, hemicellulose, lignin, lignin derivatives. The paper material may be made of sheet material having a basis weight comprised between 100 g/m$^2$ and 500 g/m$^2$. The paper material in question extends between a first and a second main extension surface. The paper sheet material employed for making the container may, in one embodiment variant thereof, be covered for at least one part of the first and/or second main extension surface by means of a plastic material covering, e.g. biodegradable. In the event in which the covering is arranged so as to at least partly cover the first main extension surface, the same covering will come to define an internal surface of the container. On the other hand, in the event in which the covering is arranged on the second main extension surface, the same covering will come to define an external surface of the container. The covering may also be employed to define a kind of water and/or moisture barrier useful for preventing the weakening and the loss of structure of the constituent paper material. The covering may be applied to the paper material (as specified above on the internal and/or external side of the support) in the form of a so-called "coating" or lacquer deposited as a solution or sprayed whose thickness is generally comprised, in a non-limiting manner, between 0.2 μm and 10 μm. Alternatively, the covering may comprise a plastic film, for example a polyethylene coating, applicable by means of a rolling process, on one or both sides (internal and/or external side) of the paper material defining the container. In the event in which the covering is applied by means of rolling, the values of the plastic film (covering) may for example vary between 10 μm and 400 μm, in particular between 10 μm and 200 μm, still more in particular between 10 μm and 80 μm, of covering material (i.e. polythene). The plastic covering material may be selected, by way of example, from among the following materials: PP, PE (HDPE, LDPE, MDPE, LLDPE), EVA, polyesters (including PET and PETg), PVdC.

The term "blank" refers to a flat semi-finished product made of sheet material, e.g. made of paper sheet material, foldable on itself for making the wall and/or the package. The blank may be made of a single piece and obtainable by means of die cutting of a single sheet.

With the expression "folded configuration of the blank" it is intended a configuration in which the blank was folded to form the container.

With the term "sheet material" it is intended a material that has two dimensions, e.g. length and width, considerably greater than a third dimension, such as for example the thickness.

With the term "panel" it is intended a laminar body of monolithic type having a substantially constant thickness which may be constituted by a single panel (mono-layer) of sheet material or by a multi-layer defined by a plurality of mono-layer sheets coupled together in thickness. The panel may, in a non-limiting manner, be extended flatwise or follow a progression that is at least partly undulated.

With the term "opening device" it is intended any one tool usable by a user for opening the package. For example, the opening device may comprise at least one selected from the following group: a body made of sheet material (e.g. a payment card, a loyalty card or a suitable key), an elongated body (e.g. a pen or a suitable key).

With the term "manually intervening" it is intended a manual action carried out by the user without the aid of tools, for example an opening device defined by a predefined key, a card. With manual action it is therefore intended the intervention of the user by means of his/her hands directly on the container.

Container 1

Reference number 1 overall indicates a container usable in the field of packaging for products of various type, for example drug products, cosmetics, cleaning products (detergents for linen and dishware), foods and tobacco-based products (cigars and cigarettes).

The container 1 comprises a storage 2 (FIG. 5) made of sheet material, for example paper material, defining a compartment 3 for housing products. The storage 2 comprises at least one lateral wall 4 defining at least one passage opening delimited by a free edge 6. The storage 2 may have a substantially prismatic shape, e.g. rectangular prismatic (it is possible to make a storage 2 having different shape, e.g. having square section, with a trapezium or cylindrical shape).

In detail, the storage 2 may comprise a front wall 4*a* and a rear wall 4*b* facing and parallel to each other: the front wall 4*a* and the rear wall 4*b* are connected to each other by means of a first and a second lateral wall 4*c*, 4*d*, also facing and parallel to each other. The front wall 4*a* is spaced and opposite the rear wall 4*b*; the first and second lateral walls 4*c*, 4*d* are also spaced and opposite from each other. The front, rear and lateral walls (4*a*, 4*b*, 4*c*, 4*d*) define the passage opening, delimited by the free edge 6.

The storage 2 also comprises a bottom wall 4*f* from which the following emerge, starting from a perimeter edge of the bottom wall 4*f* itself: the front wall 4*a*, the rear wall 4*b* and the first and second lateral walls 4*c*, 4*d*. The storage 2 thus comprises a single passage opening defined opposite the bottom wall 4*f*. In detail, the front wall 4*a*, the rear wall 4*b*, the first lateral wall 4*c* and the second lateral wall 4*d*, in cooperation with the bottom wall 4*f*, delimit the compartment 3.

The front wall 4*a*, the rear wall 4*b*, the first lateral wall 4*c* and the second lateral wall 4*d* emerge starting from the bottom wall 4*f* for a predetermined extension: such extension defines the height of the storage 2 which may be greater than 30 mm, optionally greater than 50 mm, still more optionally greater than 60 mm. The compartment 3 may have a volume greater than 40 $cm^3$, optionally greater than 100 $cm^3$ as a function of the products to be contained. For example, in the event in which the container 1 is used for containing average-sized products, the compartment 3 may have a volume comprised between 800 and 1.400 $cm^3$. For large-sized products, the volume of the compartment 3 may reach 10,000 $cm^3$.

The lateral wall 4 of the storage 2 (optionally at least one of said walls 4*a*-4*d*) comprises a flat panel 41 emerging from the bottom wall 4*f* and at least partly delimiting the compartment 3. In particular, at least one of said walls 4*a*-4*d* may be constituted by a single panel, i.e. by a single sheet of paper material. Alternatively, at least one of said walls 4*a*-4*d* of the storage 2 may comprise a first panel 41 and a second panel 42 facing and engaged with each other. The first and second panels 41, 42 may be integrally joined at a folding edge 6*a* (FIGS. 2, 3, 9, 10, 13, 14, 16 and 17) to define a folded portion; the first and second panels 41, 42 are partly in contact and constrained with each other, for example by means of gluing. In detail, the first panel 41 defines at least one part of an internal surface delimiting a part of the compartment 3 of the storage 2, while the second panel 42 defines at least one part of an external surface of the storage 2, opposite an internal surface delimiting the compartment 3 of the storage 2.

In FIGS. 5 and 7 the front wall 4*a* of the storage 2 has, in a non-limiting manner, said first and second panels 41, 42; it is possible to provide for a rear wall 4*b* also comprising said panels 41, 42. Furthermore, each wall 4*a*-4*d* may have the configuration with internal panel (first panel 41) and external panel (second panel 42) described above. Illustrated in FIGS. 2, 3, 9, 10, 13, 14, 16 and 17 is, in a non-limiting manner, a lateral wall 4 comprising said first and second panels 41, 42; nevertheless it is possible that each lateral wall 4*a*, 4*b*, 4*c* 4*d* have the first and second panels 41, 42.

In detail, the storage 2 may be substantially identical to the container of the package as described in the patent application PCT No. WO 2021/044266 A1 from page 14, line 26, to page 15, line 7.

The container 1 may comprise a closure system 7 made of sheet material, optionally paper, configured for essentially defining an element for closing the storage 2. In detail, the closure system 7 is movable, at least partly, relative to the storage 2 at least between: a closed condition where the closure system 7 prevents the communication between compartment 3 of the storage 2 and the outside environment, and an open condition where the closure system 7 allows the communication between the compartment 3 and the outside environment.

In the embodiment illustrated in FIG. 7, the closure system 7 and the storage 2 are, in a non-limiting manner, elements that are distinct and completely separable from each other. In particular, closure system 7 and storage 2 are relatively movable with respect to each other at least between: the closed condition where the closure system 7 obstructs the passage opening of the storage 2, and the open condition where the closure system 7 is separated from the storage and allows the communication between the compartment 3 and the outside environment.

The closure system 7 comprises a predetermined number of lateral walls defining at least one access delimited by a free edge 7*b* configured for allowing the passage of the storage 2. The predetermined number of lateral walls of the closure system 7 emerges from a top wall 7*a* which delimits, in cooperation with said lateral walls, an internal volume 7*f* configured for receiving at least part of the storage 2; actually, the access is configured for placing the internal volume 7*f* in communication with the outside environment, as well as to allow the insertion and the removal of the storage 2 from said internal volume 7*f*.

The relative movement between closure system 7 and storage 2 may be obtained by moving both parts, i.e. both the closure system 7 and the storage 2 or it may be obtained by means of the movement of only one of the parts.

In detail, the storage 2, in the closed condition (schematized for example in FIGS. 4 and 11), is arranged at least partly in the internal volume 7*f*: the closure system 7, in such condition, prevents the insertion and the pick-up of products from the storage 2. In the open condition, the closure system 7 is completely separated (spaced) from the storage 2 as is visible for example in FIG. 7. During the passage from the closed condition to the open condition, and vice versa, storage 2 and closure system 7 slide relative to each other close to or away from each other: during such relative movement, the bottom wall 4*f* of the storage 2 and the top walls 7*a* of the closure system 7 are moved close to or away from each other. In order to allow such relative movement, the closure system 7 has a size slightly greater than the storage 2, sufficient for allowing the insertion of the storage in the internal volume 7*f*.

The closure system 7 has a structure at least partly countershaped with respect to the storage 2 in a manner such that, in the closed condition, the closure system 7 is fit outside the storage 2. In detail, the closure system 7 comprises a front wall 8*a* and a rear wall 8*b* opposite each other and connected by means of a first and a second lateral wall 8*c* and 8*d*, also spaced and opposite each other. In detail, also the closure system 7 has a rectangular prismatic shape: the front wall 8*a* and the rear wall 8*b* (with square or rectangular shape) are facing and parallel to each other and connected together by means of the first and of the second lateral wall 8*c*, 8*d* (with square or rectangular shape), also facing and parallel to each other. In the closed condition: the front walls 4*a*, 8*a*, respectively of the storage 2 and of the closure system 7, are directly facing each other, the rear walls 4*b*, 8*b*, respectively of the storage 2 and of the closure system 7 are directly facing each other, the first lateral walls 4*c*, 8*c*, respectively of the storage 2 and of the closure system 7, are directly facing each other, and the second lateral walls 4*b*, 8*d*, respectively of the storage 2 and of the closure system 7, are directly facing each other.

It is also possible to make a closure system 7 having different form, for example having a section with trapezium shape.

Alternatively, in a second embodiment not illustrated in the enclosed figures, the closure system 7 may be engaged with the free edge 6 of the storage and be movable via rotation relative to said free edge between the open condition and the closed condition. Also in the second embodiment, the closure system 7 comprises a predetermined number of lateral walls defining at least one access delimited by a free edge 7*b* configured for allowing the insertion of the storage 2. The predetermined number of lateral walls of the closure system 7 emerges from a top wall which delimits, in cooperation with said lateral walls, the internal volume of the closure system configured for receiving at least part of the storage 2. The relative movement via rotation between closure system 7 and storage 2 may be obtained by moving both parts, i.e. both the closure system 7 and the storage 2 or it may be obtained by means of the movement of only one of the parts. In detail, the closure system 7 may be substantially identical to the casing of the package as described in the patent application PCT No. WO 2021/044266 A1 from page 15, line 8, to page 16, line 17.

The container 1 also comprises: at least one first coupling portion 12, optionally made of paper material, carried by the closure system 7, and at least one second coupling portion 13, also optionally made of paper material, carried by the storage 2 and configured for cooperating with the first coupling portion 12.

The first and second coupling portions 12, 13 are configured for being engaged with each other in the closed condition to define a locking condition of the container in which the first and second coupling portions 12, 13 prevent the closure system 7 from passing from the closed condition to the open condition.

The first coupling portion 12, shown in FIG. 6, is carried by at least one lateral wall of the closure system 7. The first coupling portion 12 comprises at least one tab 12*a* defining an undercut delimited by at least one grip edge 12*b*: such edge 12*b* is placed in the internal volume 7*f*, distinct and spaced from the free edge 7*b* of the closure system, hence being interposed between the top wall 7*a* and the free edge 7*b* of the closure system 7. In detail, the first coupling portion 12 may be integrally joined with a lateral wall of the closure system by means of a folding edge to define a folded portion in the internal volume 7*f* of the same closure system.

The first coupling portion 12 may comprise at least one tab 12*a* directly integrally joined with at least one lateral wall by means of a folding edge to define a folded portion. Indeed, the tab 12*a* is made of a single piece with a lateral wall in a manner such that said tab 12*a* is at least partly overlapped and facing the lateral wall to which said tab 12*a* is directly connected (integrally joined). In such configuration, the folding edge which joins the tab 12*a* and the lateral wall, defines at least part of the free edge 7*b* of the closure system 7. Even if the tab 12*a* is integrally joined with the lateral wall, only a part thereof defines the undercut suitable for cooperating with the second coupling portion 13.

The grip edge 12*b* may have a shape at least partially countershaped with respect to the second coupling portion 13.

The grip edge 12*b* of the tab 12*a* may be, at least for a section, tilted with respect to the free edge 7*b* of the access, optionally by an angle comprised between 20° and 80°, still more optionally by an angle comprised between 30° and 70°. In detail, the tab 12*a* extends along a plane and directly faces the lateral wall of the closure system 7 directly carrying the tab 12*a*. The tab 12*a* may be tilted with respect to the lateral wall directly carrying the tab 12*a* by an angle lower than 40°, optionally by an angle comprised between 1° and 30°. Such angle is measured between the surface of the tab 12*a* directly facing the lateral wall of the closure system 7 and the same lateral wall of the closure system 7 directly carrying (directly integrally joined) the tab 12*a*. Alternatively, the tab 12*a* may be substantially parallel to the lateral wall of the closure system 7 directly carrying said tab 12*a*. Indeed, the tab 12*a* of the first coupling portion 12 is entirely facing and overlapped to the lateral wall of the closure system 7 directly carrying the tab 12*a*.

The first coupling portion 12 may comprise two tabs 12*a* spaced and facing each other (condition not illustrated). The tabs 12*a* may be engaged at the same lateral wall of the closure system 7 and be substantially identical to each other in shape and size: the two tabs 12*a* are symmetric to each other and have respective grip edges 12*b* facing each other. The grip edges 12*b* of the two tabs 12*a* are spaced from each other and entirely positioned in the internal volume 7*f*, spaced from the free edge 7*b*: the grip edges 12*b* of the two tabs 12*a* may thus define a substantially "V" shape whose concavity is directed on the opposite side with respect to the access of the closure system 7. The grip edges 12*b* are facing the lateral wall of the closure system directly carrying (directly integrally joined) the tab 12*a*, spaced both from the free edge 7*b* and from the top wall 7*a*. In detail, the first coupling portion 12 may be substantially identical to the first coupling portion of the package, as described in the patent application PCT No. WO 2021/044266 A1 from page 16, line 18, to page 18, line 4.

In detail, the container may comprise at least one of: at least one of said first coupling portion 12 carried by the front wall 8*a* of the closure system 7, at least one of said first coupling portion 12 carried by the rear wall 8*b* of the closure system 7, at least one of said first coupling portion 12 carried by the first lateral wall 8*c* of the closure system 7, and at least one of said first coupling portion 12 carried by the second lateral wall 8*d* of the closure system 7.

In the enclosed figures the first coupling portion 12 is carried, in a non-limiting manner, by the front wall 8*a* (FIGS. 4 and 8) or by the rear wall 8*b* (FIG. 6) of the closure system 7. It is also possible to arrange one or more first coupling portions 12 on the same lateral wall and/or at least one first coupling portion 12 for each lateral wall of the closure system 7.

Alternatively, the first coupling portion 12 may be fixed with respect to the closure system 7 (condition illustrated in the enclosed figures) or it may be defined on a selector carried by the lateral wall but movable with respect to said lateral wall. For example, the first coupling portion 12 may be identical to the first coupling portion of the package as described in the patent application PCT No. WO 2021/0442668 A1 from page 20, line 9, to page 21, line 2, as well as from page 22, line 7, to page 23, line 28.

As is visible for example in FIGS. 6 and 7, the closure system 7 may also comprise a depression 18 defined at the edge 7*b*; such depression is configured for allowing a user, in the closed condition of the container, to grip the storage 2.

As mentioned above, the container comprises at least one second coupling portion 13 configured for cooperating with one or more of the first coupling portions 12 to define the locking condition. Alternatively, the container may comprise a second coupling portion 13 for each first coupling portion 12. The second coupling portion 13 is carried by at least one lateral wall of the storage 2 and emerges outside the compartment 3 of the storage 2, distinct and spaced from the free edge 6. Indeed, the first and second coupling portions, in the locking condition, are engaged outside the compartment 3 of the storage 2 and inside the internal volume 7*f* of the closure system 7.

The second coupling portion 13 comprises a respective tab 13*a* projecting from the panel 41 of the lateral wall of the storage 2 to define an undercut delimited by at least one grip edge 13*b* placed outside the compartment 3, distinct and spaced from the free edge 6 of the passage opening.

The tab 13*a* may be joined by means of a folding edge to a lateral wall 4 of the storage to define a folded portion. The tab 13*a* may thus face and at least partly overlapped to the panel 41 of the lateral wall of the storage with which said tab 13*a* is directly integrally joined. As shown in the enclosed figures, the tab 13*a* is made directly on a lateral wall of the storage 2 by means of a through cut a lateral wall itself: the tab 13*a* thus defines at least part of the lateral wall of the storage 2 to which the same tab 13*a* is integrally joined. The tab 13*a* may thus be spaced from the free edge 6 of the storage 2.

The undercut defined by the panel 13*a* of the second coupling portion 13, in the closed condition of the container, is configured for being engaged to the undercut of the tab 12*a* of the first coupling portion 12 to define the locking condition. At least one section of the grip edge 13*b* of the tab 13*a* may be tilted with respect to the free edge 6 by an angle comprised between 20° and 80°, still more optionally by an angle comprised between 30° and 70°.

The tab 13*a* may have a substantially rectangular or triangular shape, or substantially a trapezium shape or substantially "V" or "C" shape, wherein the grip edge 13*b* has at least one section, optionally two rectilinear sections, tilted with respect to the free edge 6, optionally by an angle comprised between 20° and 80°, still more optionally by an angle comprised between 30° and 70°. In more detail, the grip edge 13*b* of the tab 13*a* has a substantially "V" or "C" shape whose concavity is directed towards the free edge 6 of the storage 2. In detail, the tab 13*a* extends on a plane directly facing the panel 41 of the lateral wall of the storage directly carrying said tab 13*a*. The tab 13° may be tilted with respect to the lateral wall 4 with which it is engaged, by an angle lower than 40°, optionally by an angle comprised between 1° and 30°, measured between the surface of the tab 13*a* directly facing the lateral wall and the same lateral wall of the storage 2 directly carrying (directly integrally joined) the panel 13*a*.

Each second coupling portion 13 comprises one and only one tab 13*a* suitable for cooperating with the first coupling portion 12. As mentioned above, the container may comprise at least one second coupling portion 13. In detail, the container may comprise at least one of: at least one of said second coupling portion 13 carried by the front wall 4*a* of the storage 2, at least one of said second coupling portion 13 carried by the rear wall 4*b* of the storage 2, at least one of said second coupling portion 13 carried by the first lateral wall 4*c* of the storage 2, and at least one of said second coupling portion 13 carried by the second lateral wall 4*c* of the storage 2.

In the enclosed figures the container comprises, in a non-limiting manner, a second coupling portion 13 carried by the front wall 4*a* and a second coupling portion carried by the rear wall 4*b*. It is possible to arrange two or more second coupling portions that are distinct and spaced from each other, located on the same lateral wall and/or at least one first coupling portion for each lateral wall 4 of the container.

In more detail, the tab 13*a* emerges with respect to the panel 41 outside the compartment 3 starting from an attachment portion 13*c*, joined to the panel 41, up to an end portion, opposite said attachment portion 13*c*; the tab 13*a* is made of sheet material and is movable with respect to the lateral wall 4. In more detail, the tab 13*a* is movable at least between: a first operative position where at least the end portion of the tab 13*a* is spaced from the panel 41 of the lateral wall 4. Such end portion defines the undercut suitable to be engaged with the first coupling portion, which is delimited by said grip edge 13*b*. The grip edge 13*b*, in the first operative position, is configured for engaging the first coupling portion 12 to define said locking condition, and a second operative position where at least the end portion of the tab 13*a* is arranged at a distance from the panel 41 lower than a distance present between said panel 41 and said end portion, when the tab 13*a* is placed in the first operative position. The undercut, delimited by the grip edge 13*b*, in the second operative position, is configured for disengaging the first coupling portion 12 to allow the passage of the closure system 7 from the closed condition to the open condition.

As is visible from the enclosed figures, the tab 13*a* emerges with respect to the panel 41 away from the free edge 6 of the storage 2 and is configured for being moved, in the closed condition of the container (optionally in the closed condition and in the locking condition of the container) close to and away from the panel 41 of the lateral wall 4 directly carrying said second coupling portion 13. The tab 13*a* has a substantially elastic structure given by the sheet material, which allows normally maintaining the tab 13*a* itself a distance (emerging) from the panel 41, i.e. in the first operative position; indeed, the tab 13*a*: the tab, due to the elastic structure, is movable in a manner such that at least the grip edge 13*b* (optionally the end portion of the tab 13*a* opposite the attachment edge 13*c*) may be moved close to and away from the panel 41 (first and second operative positions).

In more detail, the tab 13*a* is integrally joined with the second panel 42 of the lateral wall 4 (FIG. 4) at an attachment edge 13*c*, spaced from the free edge 6 of the storage 2: the tab 13*a* emerges from the second panel 42 away from the first panel 41 and away from the free edge 6. The tab 13*a* is movable between the first and the second operative position substantially around the attachment edge 13*c*, close to and away from the first panel 41.

The tab 13*a*, both in the first and in the second operative position, projects from the lateral wall 4 to which said tab 13*a* is integrally joined, according to a sense exiting from the compartment 3. In detail, the tab 13*a*, both in the first and in the second operative position, projects from the second panel 42 to which said tab 13*a* is integrally joined, according to a sense exiting from the compartment 3. Furthermore, the tab 13*a*, both in the first and in the second operative position, is tilted with respect to the panel (optionally both to the first and to the second panel); for example, the tab 13*a*, in the second operative position is tilted with respect to the first panel 41 by an angle greater than 1°, optionally comprised between 2° and 15°. In detail, the tab 13*a*, in the first operative position, is tilted with respect to the first panel 41 by an angle greater than an angle subtended by the same first panel 41 and by the same tab 13*a* when said tab 13*a* is in the second operative position.

The tab 13*a* may be made directly on the second panel 42 (FIGS. 2 and 5), for example making a through notch on the same second panel 42; the notching action allows delimiting the tab 13*a* and defining on the same at least one seat 43 delimited by a perimeter edge 44. The tab 13*a* thus faces the seat 43 and is configured for emerging from said seat along a direction exiting the storage. The seat 43 may have a surface extension greater than a surface extension of the tab 13*a* (FIGS. 1-7). In particular, the surface extension of the seat 43 is greater than a quantity comprised between 10% and 50% of the surface extension of the tab 13*a*. The perimeter edge 44 of the seat 43 is thus greater than the grip edge 13*b* of the second coupling portion 13.

Alternatively, as shown in FIGS. 8-17, the seat 43 has an extension surface extension substantially equal to the surface extension of the tab 13*a* of the second coupling portion 13.

It is possible to make a lateral wall 4 carrying said second coupling portion 13 comprising only one panel 41 from which the tab 13*a* emerges (condition not illustrated).

The container 1 also comprises at least one spacer 30, also made of sheet material, optionally paper, interposed between the tab 13*a* of the second coupling portion 13 and the panel 41 of the lateral wall 4. The spacer 30 is at least partly facing the tab 13*a* of the second coupling portion 13 and is configured for opposing the contact between the end portion of the tab 13*a* and the panel, in particular preventing the contact between the grip edge 13*b* and the panel 41 (optionally the first panel 41). In other words, the spacer 30 is configured for maintaining a predetermined distance between said panel 41 of the lateral wall and the tab 13*a* of the second coupling portion 13, optionally between the first panel 41, and the end portion of the tab 13*a* (optionally the grip edge 13*b*) of the second coupling portion 13.

The spacer 30 is configured for maintaining the tab 13*a* tilted with respect to the panel 41 (optionally al first panel 41), also in the second operative position of the tab 13*a*. In this manner, the spacer only allows a minimum displacement of the tab 13*a*, preventing undesired excessive deformations of the tab, such to compromise the operation thereof; in addition, the spacer 30 allows forcing the tab 13*a* to maintain the first operative position in which said tab 13*a* engages the first coupling portion; in this manner, the spacer is capable of ensuring the correct engagement of the first and second coupling portions such to render the container highly effective against opening by children.

The spacer 30 comprises at least one tab 31 made of sheet material, optionally paper, directly carried by at least one between the panel of the lateral wall 4 and the tab 13*a* of the second coupling portion 13. The auxiliary tab 31 is at least partly facing the tab 13*a* of the second coupling portion 13 to essentially define a kind of counter-thickness suitable for maintaining at a distance, in any one operative condition of the second coupling portion, the grip edge 13*b* (optionally, more generally, an end portion of the tab 13*a* opposite the attachment edge 13*c*) of the tab 13*a* with the panel 41, optionally with the first panel 13*a*.

In a first embodiment illustrated in FIGS. 2-5 and 7, the auxiliary tab 31 of the spacer 30 is integrally joined with the tab 13*a* at the grip edge 13*b*; the auxiliary tab 31 is overlapped to the tab 13*a*, in particular is folded above the tab 13*a* starting from the grip edge 13*b*: in such embodiment, the auxiliary tab 31 may be constrained to the tab 13*a*, for example by means of gluing in a manner such that said auxiliary tab 31 may be extended substantially parallel to the section of the tab 13*a* of the second coupling portion 13 directly facing said auxiliary tab 31. In such configuration, the auxiliary tab 31 defines a kind of counter-thickness carried directly by the tab 13*a* of the second coupling portion: the auxiliary tab 31, in the first operative position, is spaced from the first panel 41 while in the second operative position is configured for contacting the first panel 41 to prevent the grip edge 13*b* from contacting said first panel 41, obstructing the complete folding of the tab 13*a*.

It is possible to make an auxiliary tab 31 constrained to the grip edge 13 of the tab 13*a*, movable with respect to said tab (condition not illustrated). For example, the auxiliary tab 31 may be folded with respect to the tab 13*a* of the second coupling portion 13 at the grip edge 13*b* to define a return element, for example of elastic type configured for contacting the panel (in particular the first panel 41) to push the tab 13*a* in the first operative position. Actually, the auxiliary tab 31 is configured for forcing the tab 13*a* to maintain the first operative position. The auxiliary tab 31 of the spacer 30 is integrally joined with the tab 13*a* of the second coupling portion 13 and defines, with said tab 13*a*, a single tab configured for normally maintaining a substantially "V"-shaped conformation adapted to force the movement of the tab 13*a* in the first operative position.

In FIGS. 9-11, 16 and 17, a second embodiment is shown of the spacer 30 carried directly by the panel (optionally by first panel 41) of the lateral wall. In detail, the auxiliary tab 31 may be integrally joined with the panel 41 and folded with respect to said panel towards the tab 13*a*. In such embodiment, the auxiliary tab 31 defines a counter-thickness carried directly by the first panel 41 which is configured for contacting the tab 13*a* of the second coupling portion in the second operative position to maintain the end portion (optionally the grip edge 13*b*) of the tab 13*a* at a distance from the first panel 41, thus preventing an excessive folding of the tab 13*a* in the seat 43. The auxiliary tab 31 may be extended along a plane parallel to a lying plane of the first panel 41 (FIGS. 10 and 11).

Alternatively, the auxiliary tab 31 may be integrally joined with the panel 41 and folded with respect to said panel to define a return element, e.g. of elastic type. In such configuration, the auxiliary tab 31 defines a single body with said first panel 41, configured for normally maintaining a substantially "V"-shaped conformation suitable for forcing the first operative position of the tab 13*a*. The defined return element of the auxiliary tab 31, at least in the second operative position of the second coupling portion 13, is configured for contacting the tab 13*a* of the second coupling portion 13 to push said tab 13*a* in the first operative position: the auxiliary tab 31 is thus configured for forcing the tab 13*a* to maintain the first operative position.

Figure 17:
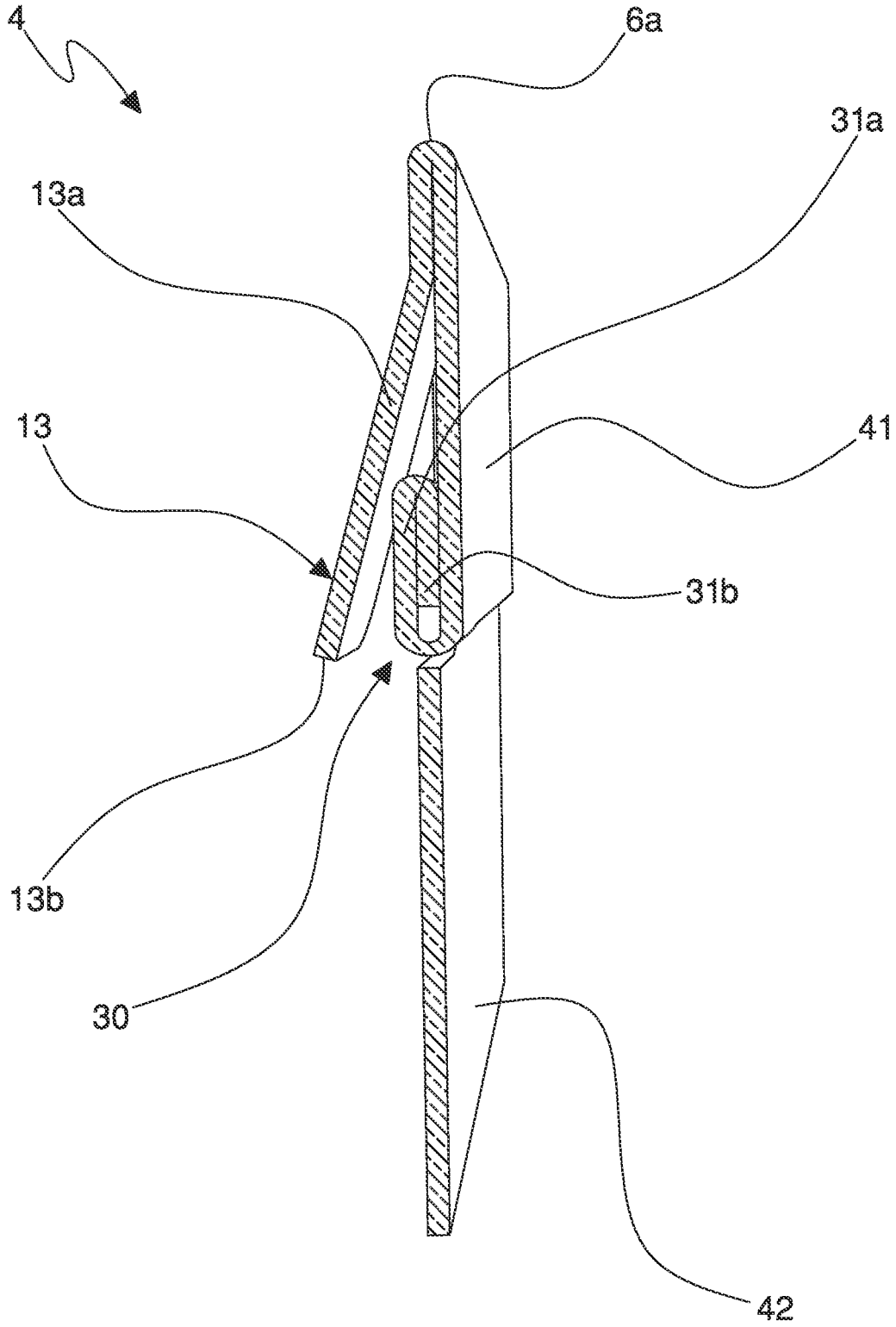
FIG. 17 is a sectional detailed view of the wall of FIG. 16.

As shown in FIG. 17, the spacer 30 may comprise a first and a second auxiliary tab 31*a*, 31*b* overlapped to each other and both engaged with the first panel 41; the first and second auxiliary tabs 31*a*, 31*b* may be joined together by means of gluing to define a kind of double thickness: the first and second auxiliary tabs 31*a*, 31*b* may then lie on respective ideal planes that are substantially parallel to each other.

Figure 14:
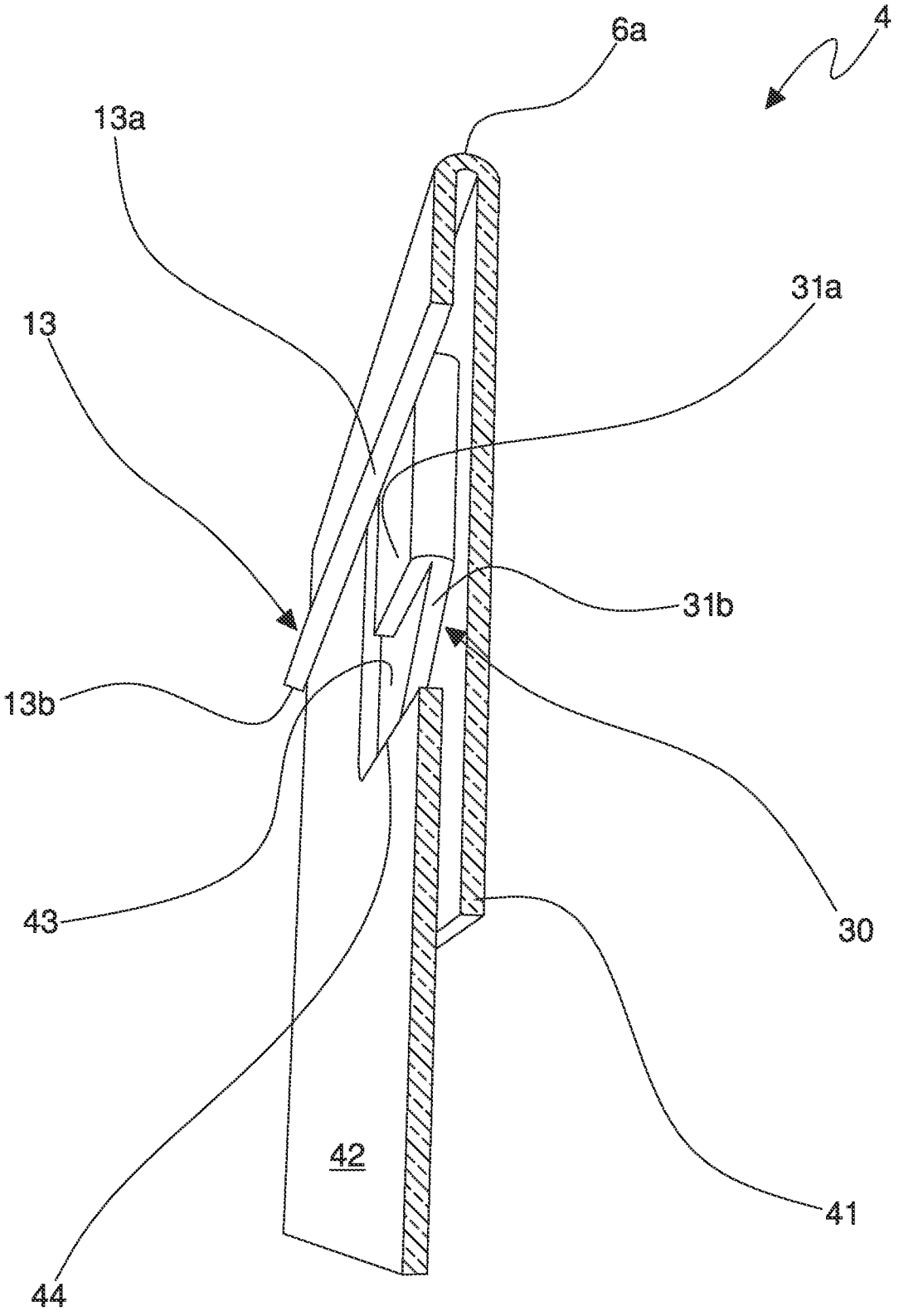
FIG. 14 is a sectional detailed view of the wall of FIG. 12.

Alternatively, the auxiliary tab 31 of the spacer 30 may be carried by an intermediate panel interposed between the first and second panels (FIGS. 13 and 14).

In any one embodiment, the spacer 30 is at least partly arranged in the seat 43 of the second panel 42. The auxiliary tab 31, at least in the second operative position of the tab 13*a*, is arranged at least in part in the seat 43 and configured for obstructing the insertion of said tab 13*a* in the seat 43 of the second panel 42.

In fact, the tab 13*a* is configured for being moved with respect to the lateral wall 4 of the storage, at least in the closed condition (optionally also in the locking condition) of the container; such movement allows a safe closure of the container 1 and simultaneously allows a user to execute a quick and easy opening of the same. The spacer 30 is configured for preventing, in the closed and/or locking condition of the container, the tab 13*a* of the second coupling portion from being locked in the second operative position, thus preventing the locking of the container 1 in the closed condition, and it prevents undesired deformations in the tab 13*a* which may damage the structure thereof, e.g. reducing the elastic return properties of the same.

The container 1 may also comprise an unlocking portion 60 configured for defining at least one through access 61 on the closure system (optionally on a lateral wall of the closure system), at the first and second coupling portions 12, 13; the unlocking portion 60 is configured for allowing a user, at least in the locking condition and from outside the container, to access at least one of said first and second coupling portions 12, 13 to allow the disengagement thereof.

In detail, the unlocking portion 60 is configured for allowing a user, at least in the locking condition and from outside the container, to intervene (e.g. manually and/or by means of an opening device insertable through the through access 61) on the tab 13*a* of the second coupling portions 13.

The unlocking portion 60 may comprise, in a non-limiting manner, a through access 61 defined on at least one lateral wall of the closure system 7. Alternatively, the unlocking portion 60 may comprise a deformable portion (not shown in the enclosed figures) placed, in the locking condition, in front of the first and second coupling portions 12, 13: in such configuration, the unlocking portion 60 essentially comprises a thrust portion configured for being moved (manually by the user or by means of an opening device) between a thrust condition and a rest condition. In the rest condition, the thrust portion is spaced from at least one of said first and second coupling portions (optionally by both coupling portions), while in the thrust condition the thrust portion operates on the at least one of said first and second coupling portions 12, 13 to allow the disengagement thereof. Indeed, the thrust portion may act functionally as a button. The push of a user's finger on the thrust portion according to a direction entering the container allows the thrust portion to come into contact with the second coupling portion 13, disengaging it from the undercut of the first coupling portion 12. The thrust portion may be reversibly movable between the thrust condition and the rest condition. For such purpose, the thrust portion may be elastically deformable between the thrust condition and the rest condition.

If multiple second coupling portions are present, the container may comprise only one unlocking portion 60 suitable for allowing the intervention by the user on the plurality of second coupling portion or it may comprise a dedicated unlocking portion 60 for each second coupling portion 13.

Process

Also forming the object of the present invention is a process of making a container 1 according to the description reported above and/or according to any one of the enclosed claims.

The process comprises a step of arranging the storage 2; such step may provide for the die cutting of a flat sheet in paper material to define a blank which, due to subsequent steps of folding and gluing, defines said storage 2.

The blank 50 used for making the storage 2 comprises: at least one central sheet, at least one first lateral sheet 52 integrally joined with and emerging from the central sheet, at least one second lateral sheet 53 integrally joined with the first lateral sheet 52 and emerging from said first lateral sheet on the opposite side with respect to the central sheet, and at least one auxiliary sheet 54 integrally joined directly to the first or to the second lateral sheet 52, 53, in which said auxiliary sheet 54 is spaced from the central sheet by a U-shaped gap 55 in the first lateral sheet 52.

The process comprises the steps of: folding the first and second lateral sheets 52, 53 with respect to the central sheet to define respectively the second and the first panel 42, 41 of the storage 2, in which the central sheet, following the folding step, defines the bottom wall 4*f* of the storage 2, and folding the auxiliary sheet 54 with respect to at least one between the first and second lateral sheets 52, 53 to define the spacer 30.

In the enclosed figures, for the sake of simplicity, only a part of the blank used for making only a lateral wall 4 was illustrated. For example, the entire blank 50 may be substantially identical to the blank used for making the container of the package as described in the patent application PCT WO 2021/044266 A1 from page 23, line 27, to page 24, line 33. In addition to the blank of the patent application PCT No. WO 2021/044266 A1, the blank of the present invention comprises the auxiliary sheet employed for making the spacer. In detail, the blank 50 of FIG. 1, when folded is configured for defining the wall illustrated in FIGS. 2 and 3. The blank 50 of FIG. 8, when folded, is configured for defining the lateral wall 4 illustrated in FIGS. 9 and 10. The blank 50 of FIG. 12, when folded, is configured for defining the lateral wall 4 illustrated in FIGS. 13 and 14. The blank 50 of FIG. 15, when folded, is configured for defining the lateral wall 4 illustrated in FIGS. 16 and 17.

In detail, to make the container of FIG. 5, the blank 50 may comprise central sheet having rectangular shape from which a blank portion emerges for each side, as illustrated in FIGS. 1, 8, 12 and 15; in particular, the container 1 of FIG. 5 was made by means of the blank 50 of FIG. 1, in detail by means of four blanks according to FIG. 1, each emerging from a flat central sheet having rectangular shape.

As is visible, the first lateral sheet 52 may comprise a first portion 52*a* suitable for defining the second panel 42 of the lateral wall of the storage 2 and at least one second portion 52*b* configured for defining the tab 13*a* of the second coupling portion 13. The first portion 52*a* of the first lateral wall 52 comprises a notch 56 suitable for defining the seat 44 of the second panel 42 and from which the second portion 52*b* is obtained.

The second lateral sheet 53 comprises a single portion 53*a* configured for defining the first panel 41 of the lateral wall of the storage 2. The auxiliary sheet 54 comprises at least one first portion 54*a* integrally joined with at least one between: the first portion 52*a* of the first lateral sheet 52, the second portion 52*b* of the first lateral sheet 52, the second lateral sheet 53. The auxiliary sheet 54 comprises a first and a second portion 54*a*, 54*b* that are integrally joined; the process comprises a step of folding the blank 50 in a manner such that said first and second portions 54*a*, 54*b* of the auxiliary sheet 54 may define the first and second auxiliary tabs 31*a*, 31*b* of the spacer 30.

The present invention involves advantages with respect to the solutions of the state of the art. The tab 13*a* of the second coupling portion 13 is movable with respect to the closure system; it is indicated that an excessive folding of the tab 13*a* and/or a prolonged use of the container can damage the second coupling portion 13, for example reducing the capacity thereof to maintain the first operative position. The spacer 30 allows, also following an extended use, to support the tab 13*a* in a manner such that the same may correctly define the first operative position in which it engages the first coupling portion 12. In addition, the spacer 30 prevents the tab 13*a* from being locked in an undesired manner against the lateral wall, for example in the seat 43. Finally, it is indicated that several containers of the state of the art require the folding of elastic return portions according to a direction orthogonal to an extension direction of the fibers of the paper sheet material (so-called counter-fiber folding), thus constraining the production process of the container. The spacer 30 allows overcoming such limitation; indeed, the spacer 30 allows supporting and structuring the tab 13*a* such that the same may correctly maintain the first operative position (position in which the tab 13*a* is configured for engaging the first coupling portion 12) independent of the folding carried out; in such condition, the tab 13*a* may be easily obtained both by means of a counter-fiber folding action and by means of a folding according to the fiber (i.e. by means of a folding along a direction parallel to the extension direction of the fibers of the paper sheet material), with considerable increase of the container production flexibility.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both, unless the this application states otherwise. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A child-proof container comprising:

a storage defining a compartment and including a lateral wall defining a passage opening delimited by a free edge, said passage opening being configured to place the compartment in communication with an outside environment, a closure system movable with respect to the storage at least between:

a closed condition where the closure system prevents communication between the compartment and the outside environment, an open condition where the closure system allows the communication between the compartment and the outside environment, at least one first coupling portion carried by the closure system, at least one second coupling portion carried by the storage and configured for cooperating with said first coupling portion, wherein the first coupling portion and the second coupling portion are configured to engage each other in the closed condition of the container to define a locking condition, where said first coupling position and said second coupling portion prevent the closure system from passing from the closed condition to the open condition, wherein the second coupling portion comprises at least one tab outside the compartment and the at least one tab defines at least one undercut configured to engage the first coupling portion of the closure system to define said locking condition, wherein the container comprises at least one spacer at least partly interposed between the tab of the second coupling portion and the lateral wall of the storage, wherein the tab of the second coupling portion, in the closed condition, is movable at least between:

a first operative position where the tab is configured to engage the first coupling portion to define said locking condition, and a second operative position where the tab is configured to disengage the first coupling portion to allow the passage of the closure system from the closed condition to the open condition.

2. The container according to claim 1, wherein the lateral wall of the storage comprises at least one panel, wherein an auxiliary tab of the spacer is at least partly interposed between the tab of the second coupling portion and the panel of the lateral wall.

3. The container according to claim 2, wherein at least one part of said tab of the second coupling portion emerges with respect to the panel outside the compartment to define said undercut, and wherein an axillary tab of the spacer, in the closed condition, is configured to space at least said part of the tab of the second coupling portion from the panel of the lateral wall.

4. The container according to claim 1, wherein the spacer comprises an auxiliary tab integrally joined with the tab of the second coupling portion, and wherein the auxiliary tab is folded with respect to said tab of the second coupling portion.

5. The container according to claim 4, wherein the auxiliary tab of the spacer defines a grip edge.

6. The container according to claim 1, wherein the spacer, in the closed condition, is spaced from the free edge of the storage.

7. The container according to claim 1, wherein the tab of the second coupling portion is at least partly delimited by a grip edge which, in the first operative position, is configured to define at least part of said undercut suitable for engaging the first coupling portion, wherein the grip edge, in the first operative position, is spaced from the panel.

8. The container according to claim 4, wherein the auxiliary tab of the spacer is glued to the tab of the second coupling portion, wherein the auxiliary tab of the spacer is configured to move together with the tab of the second coupling portion between the first operative position and the second operative position.

9. The container according to claim 4, wherein the auxiliary tab of the spacer, in the open condition, extends parallel to the tab of the second coupling portion.

10. The container according to claim 4, wherein the auxiliary tab of the spacer is carried directly by the panel of the lateral wall and folded with respect to said panel towards the tab of the second coupling portion.

11. The container according to claim 4, wherein the auxiliary tab of the spacer defines, with the tab of the second coupling portion, a single tab having, in the closed condition of the container, a "V" shape configured to force the tab of the second coupling portion to maintain the first operative position.

12. The container according to claim 1, wherein the lateral wall of the storage comprises a first panel facing and engaging a second panel, wherein the first panel defines at least one part of an internal surface delimiting a part of the compartment of the storage, and the second panel defines at least one part of an external surface of the storage, and wherein the tab of the second coupling portion comprises an attachment edge integrally joined with the second panel.

13. The container according to claim 12, wherein the second panel comprises a seat delimited by a perimeter edge, wherein said spacer is at least partly arranged in said seat, the tab of the second coupling portion facing the seat, and wherein the auxiliary tab of the spacer, at least in the second operative position, is arranged at least in part in the seat, wherein the auxiliary tab is configured for obstructing the insertion of the tab of the second coupling portion in the seat of the second panel.

14. The container according to claim 12, wherein the tab of the second coupling portion, in the closed condition, is movable close to and away from the first panel, wherein the spacer is configured for maintaining the tab of the second coupling portion spaced from the first panel.

15. A child-proof container comprising:

a storage defining a compartment and including a lateral wall defining a passage opening delimited by a free edge, said passage opening configured to place the compartment in communication with an outside environment, a closure system movable with respect to the storage at least between:

a closed condition where the closure system prevents the communication between the compartment and the outside environment, an open condition where the closure system allows the communication between the compartment and the outside environment, at least one first coupling portion carried by the closure system, at least one second coupling portion carried by the storage and configured for cooperating with said first coupling portion, wherein the first coupling position and the second coupling portion are configured to engaged each other in the closed condition of the container to define a locking condition where said first coupling position and the second coupling portion prevent the closure system from passing from the closed condition to the open condition, wherein the second coupling portion comprises at least one tab outside the compartment and defining at least one undercut configured to engage the first coupling portion of the closure system to define said locking condition, wherein the container comprises at least one spacer at least partly interposed between the tab of the second coupling portion and the lateral wall of the storage, and wherein the spacer comprises an auxiliary tab in a single piece with and glued to the tab of the second coupling portion.

16. The container according to claim 15, wherein the spacer, in the closed condition, is spaced from the free edge of the storage, wherein the free edge defines an edge of the container nearest the closure system during the closed condition.

17. The container according to claim 15, wherein the tab of the second coupling portion is movable at least between:

a first operative position where the tab is configured to engage the first coupling portion to define said locking condition, and a second operative position where the tab is configured to disengage the first coupling portion to allow the passage of the closure system from the closed condition to the open condition.

18. The container according to claim 17, wherein the auxiliary tab of the spacer is configured to move with the tab of the second coupling portion between the first operative position the second operative position.

19. The container according to claim 15, wherein the auxiliary tab of the spacer, in the open condition, extends parallel to the tab of the second coupling portion.

20. The container according to claim 15, wherein the lateral wall of the storage comprises at least one panel, wherein the spacer is at least partly interposed between the tab of the second coupling portion and the panel of the lateral wall, and wherein the auxiliary tab of the spacer is carried directly by the panel of the lateral wall and folded with respect to said panel.

* * * * *